US010356855B2

(12) United States Patent
Kubo et al.

(10) Patent No.: US 10,356,855 B2
(45) Date of Patent: Jul. 16, 2019

(54) MICROWAVE HEATING APPARATUS

(71) Applicant: Panasonic Intellectual Property Management Co., Ltd., Osaka-shi, Osaka (JP)

(72) Inventors: Masayuki Kubo, Shiga (JP); Koji Yoshino, Shiga (JP); Masafumi Sadahira, Shiga (JP); Daisuke Hosokawa, Shiga (JP); Yoshiharu Omori, Shiga (JP); Keijirou Kunimoto, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 749 days.

(21) Appl. No.: 14/785,224

(22) PCT Filed: Apr. 18, 2014

(86) PCT No.: PCT/JP2014/002212

§ 371 (c)(1),
(2) Date: Oct. 16, 2015

(87) PCT Pub. No.: WO2014/171152

PCT Pub. Date: Oct. 23, 2014

(65) Prior Publication Data

US 2016/0088690 A1 Mar. 24, 2016

(30) Foreign Application Priority Data

Apr. 19, 2013 (JP) ..... 2013-088091
Jun. 20, 2013 (JP) ..... 2013-129154

(51) Int. Cl.
*H05B 6/72* (2006.01)
*H05B 6/70* (2006.01)

(52) U.S. Cl.
CPC ..... *H05B 6/725* (2013.01); *H05B 6/70* (2013.01)

(58) Field of Classification Search
CPC ..... H05B 6/725; H05B 6/70
(Continued)

(56) References Cited

U.S. PATENT DOCUMENTS 4,568,811 A 2/1986 Yoshimura et al.
5,948,310 A * 9/1999 Shon ..... H05B 6/708 219/695

(Continued)

FOREIGN PATENT DOCUMENTS

CN 101473693 A 7/2009
EP 2 230 464 A1 9/2010

(Continued)

OTHER PUBLICATIONS

Translation of JP2007-141538A, Japan Patent Office (JPO), Microwave heating device, Jun. 7, 2007.*

(Continued)

*Primary Examiner* — Quang T Van
(74) *Attorney, Agent, or Firm* — Brinks Gilson & Lione

(57) ABSTRACT

A microwave heating apparatus includes: a heating chamber which houses a heating object; a microwave generating unit which generates a microwave; a transmitting unit which transmits the microwave generated by the microwave generating unit; a waveguide-structure antenna which radiates to the heating chamber the microwave transmitted from the transmitting unit; and a rotation driving unit which drives the waveguide-structure antenna to rotate, wherein the waveguide-structure antenna has a microwave sucking-out opening in a wall surface forming a waveguide structure of the waveguide-structure antenna.

10 Claims, 22 Drawing Sheets

(58) Field of Classification Search
USPC ..... 219/660, 690, 680, 702, 706, 710, 219/745–750, 751, 696, 705, 709, 720, 219/739, 741, 742, 753, 778, 764; 333/33, 204, 247, 219, 164
See application file for complete search history.

(56) References Cited

U.S. PATENT DOCUMENTS

| | | | |
|---|---|---|---|
| 5,986,249 | A | 11/1999 | Yoshino et al. |
| 8,987,644 | B2 | 3/2015 | Mori et al. |
| 2005/0230385 | A1 | 10/2005 | Lee et al. |
| 2009/0206071 | A1 | 8/2009 | Mori et al. |
| 2014/0166645 | A1 | 6/2014 | Sadahira et al. |

FOREIGN PATENT DOCUMENTS

| | | | |
|---|---|---|---|
| EP | 2 393 340 | A1 | 12/2011 |
| EP | 2 648 479 | A1 | 10/2013 |
| JP | 60-130094 | A | 7/1985 |
| JP | 2894250 | B2 | 5/1999 |
| JP | 2001-304573 | A | 10/2001 |
| JP | 2005-235772 | A | 9/2005 |
| JP | 2007-141538 | A | 6/2007 |
| JP | 2007-294477 | A | 11/2007 |
| WO | WO 2012/073451 | A1 | 6/2012 |
| WO | WO 2013/018358 | A1 | 2/2013 |

OTHER PUBLICATIONS

Translation JP207-294477A, Japan Patent Office (JPO), Microwave heating device, Nov. 8, 2007.*

International Search Report, and English language translation thereof, in corresponding International Application No. PCT/JP2014/002212, dated Jul. 8, 2014, 5 pages.

International Preliminary Report on Patentability, and English language translation thereof, in corresponding International Application No. PCT/JP2014/002212 dated Oct. 29, 2015, 14 pages.

Office Action, and English language translation of Search Report, in corresponding Chinese Application No. 201480016689.5, dated Jun. 2, 2016, 8 pages.

Extended European Search Report in corresponding European Application No. 14785578.7, dated Apr. 11, 2016, 9 pages.

* cited by examiner

| OPENING POSITION / OPENING SHAPE | CENTER IN WIDTH DIRECTION OF WAVEGUIDE | NEAR EDGE IN WIDTH DIRECTION OF WAVEGUIDE |
|---|---|---|
| I-SHAPE L60,W10 (5-600mm$^2$) (50-60mm) |  |  |
| X-SHAPE L46,W10 (820mm$^2$) (46mm) |  |  |
| RECTANGLE SHAPE L30,W30 (900mm$^2$) (42mm) |  |  |
| CIRCULAR SHAPE R20 (1,256mm$^2$) (40mm MULTIPLE) |  |  |

CIRCULARLY POLARIZED WAVE IS GENERATED

Fig.21
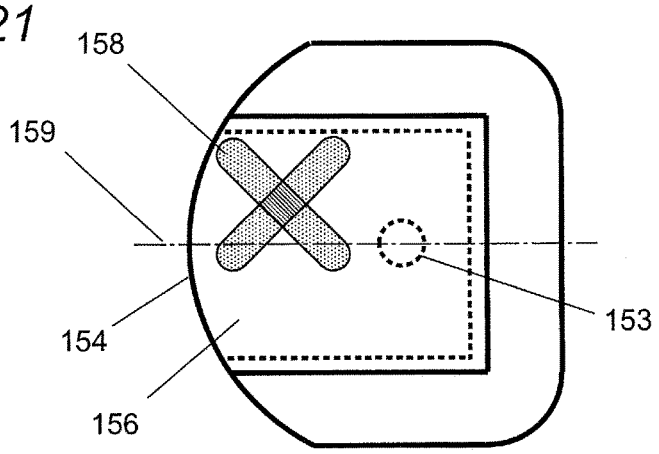
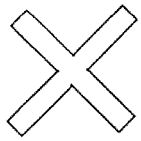
Fig.22A
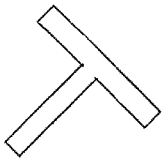
Fig.22B
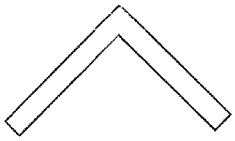
Fig.22C
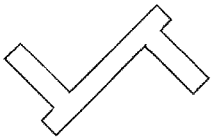
Fig.22D
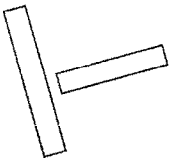
Fig.22E
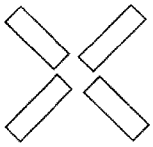
Fig.22F
Fig.23
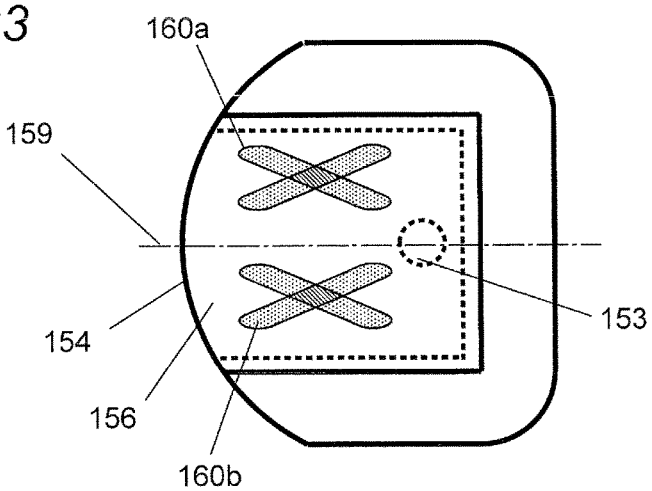

MICROWAVE HEATING APPARATUS

This application is a 371 application of PCT/JP2014/002212 having an international filing date of Apr. 18, 2014, which claims priority to JP 2013-088091 filed Apr. 19, 2013 and JP 2013-129154 filed Jun. 20, 2013, the entire contents of which are incorporated herein by reference.

TECHNICAL FIELD

The present invention relates to a microwave heating apparatus such as a microwave oven which radiates microwaves to inductively heat a heating object.

BACKGROUND ART

A microwave oven as a typical microwave heating apparatus supplies a microwave radiated from a magnetron as a typical microwave generating unit, into a metal heating chamber to inductively heat a heating object in the heating chamber.

In recent years, a highly convenient product has been put into practical use, where a bottom surface is made flat and a food can be arranged both left and right to heat two foods. However, if a frozen food and a room-temperature food are heated at the same time as the two foods, for example, the room-temperature food will be finished earlier. Therefore, in order to finish two foods at the same time, a food at a lower temperature should be intensively heated. In such a case, a function is required that enables local intensive heating instead of uniformly heating the entire heating chamber. This function can be achieved by those having a rotating antenna with a rotation shaft at substantially the center of a heating chamber bottom surface so that the stop position control of the rotating antenna is provided based on inside temperature distribution detected by an infrared sensor (see, e.g., Patent Documents 1 and 2).

The rotating antenna is designed to have high outward directivity of microwave with respect to the rotation shaft so that when the rotating antenna is stopped toward a food on the lower temperature when cooking two foods, the food can be intensively heated. Waveguide-structure antennas 1, 11, 21 as shown in FIGS. 34 to 37 are known as rotating antennas excellent particularly in local heating performance (see Patent Documents 1 and 2). FIGS. 34 and 35 depict a waveguide-structure antenna 1 described in Patent Document 1. FIGS. 36 and 37 depict waveguide-structure antennas 11 and 21, respectively, described in Patent Document 2.

The waveguide-structure antennas 1, 11, 21 have box-shaped waveguide structures 3, 13, 23 configured to surround coupling shafts 2, 12, 22 to which microwaves are supplied. Wall surfaces forming the waveguide structures 3, 13, 23 have upper wall surfaces 4, 14, 24 connected to the coupling shafts 2, 12, 22, and side wall surfaces 5*a* to 5*c*, 15*a* to 15*c*, 25*a* to 25*c* around the upper wall surfaces 4, 14, 24 closing the structures in three directions. The wall surfaces forming the waveguide structures 3, 13, 23 also have flanges 7, 17, 27 which are formed on the outside of the side wall surfaces 5*a* to 5*c*, 15*a* to 15*c*, 25*a* to 25*c* and in parallel with heating chamber bottom surfaces 6, 16, 26 via a slight gap. The wall surfaces form distal-end opening parts 8, 18, 28 widely opened only at a distal end toward one direction. In such a configuration, a large portion of microwaves is radiated only from the distal-end opening parts 8, 18, 28 to enhance the directivity of microwaves toward the distal-end opening parts 8, 18, 28 from the coupling shafts 2, 12, 22. Such a microwave supply system is rotated around the coupling shafts 2, 12, 22 and therefore may also be referred to as a rotating waveguide system.

PATENT DOCUMENTS

Patent Document 1: JP S60-130094 A
Patent Document 2: JP 2894250 B

SUMMARY OF THE INVENTION

Problems be Solved by the Invention

Although the conventional microwave heating apparatuses radiate microwaves only from the distal-end opening parts 8, 18, 28 of the waveguide-structure antennas and therefore can locally heat heating objects close to the distal-end opening parts 8, 18, 28, it is difficult to heat the object distant from the distal-end opening parts 8, 18, 28. Although the local heating performance of the waveguide-structure antennas 1, 11, 21 can be controlled in the rotation direction (circumferential direction) around the coupling shafts 2, 12, 22 by setting the direction of the distal-end opening parts 8, 18, 28, the control is difficult in the radial direction and also the local heating can be achieved only in a place close to the distal-end opening parts 8, 18, 28. For example, a heating object may be placed at a position closer to the coupling shafts 2, 12, 22 than the distal-end opening parts 8, 18, 28 or may be placed at a position more distant from the coupling shafts 2, 12, 22 than the distal-end opening parts 8, 18, 28. In such a case, heating distribution occurs such that the heating object is strongly heated at a part close to the distal-end opening parts 8, 18, 28 while a part distant from the distal-end opening parts 8, 18, 28 is less heated. Since the position of the heating object varies depending on the preference of a user, is a difficult problem to arrange the distal-end opening parts 8, 18, 28 how far from the coupling shafts 2, 12, 22. If the distance of the distal-end opening parts 8, 18, 28 from the coupling shafts 2, 12, 22 is designed short, a heating object placed near an edge in the heating chamber cannot locally be heated. On the other hand, if the distance of the distal-end opening parts 8, 18, 28 from the coupling shafts 2, 12, 22 is designed long, a heating object placed near the center in the heating chamber cannot locally be heated. Such a dilemma occurs.

The present invention has been developed to solve the problem and is intended to provide a microwave heating apparatus having the controllability in the radial direction of local heating performance of a rotationally-controlled waveguide-structure antenna to perform local heating depending on a position of a heating object.

Means to Solve the Problems

In solving the above-described conventional problem, a microwave heating apparatus includes: a heating chamber which houses a heating object; a microwave generating unit which generates a microwave; a transmitting unit which transmits the microwave generated by the microwave generating unit; a waveguide-structure antenna which radiates to the heating chamber the microwave transmitted from the transmitting unit; and a rotation driving unit which drives the waveguide-structure antenna to rotate, wherein the waveguide-structure antenna has a microwave sucking-out opening in a wall surface forming a waveguide structure of the waveguide-structure antenna.

Effects of the Invention

The present invention can provide the controllability in the radial direction of the local heating performance of the rotationally controlled waveguide-structure antenna and can perform local heating depending on a position of a heating object.

BRIEF DESCRIPTION OF THE DRAWINGS

FIG. 21 is a plan view of a waveguide-structure antenna in other embodiment of the present invention.

FIGS. 22A, 22B, 22C, 22D, 22E and 22F are views showing various shapes of microwave sucking-out openings in other embodiments of the present invention.

FIG. 23 is a plan view of a waveguide-structure antenna in other embodiment of the present invention.

DETAILED DESCRIPTION OF THE PREFERRED EMBODIMENTS

Figure 1:
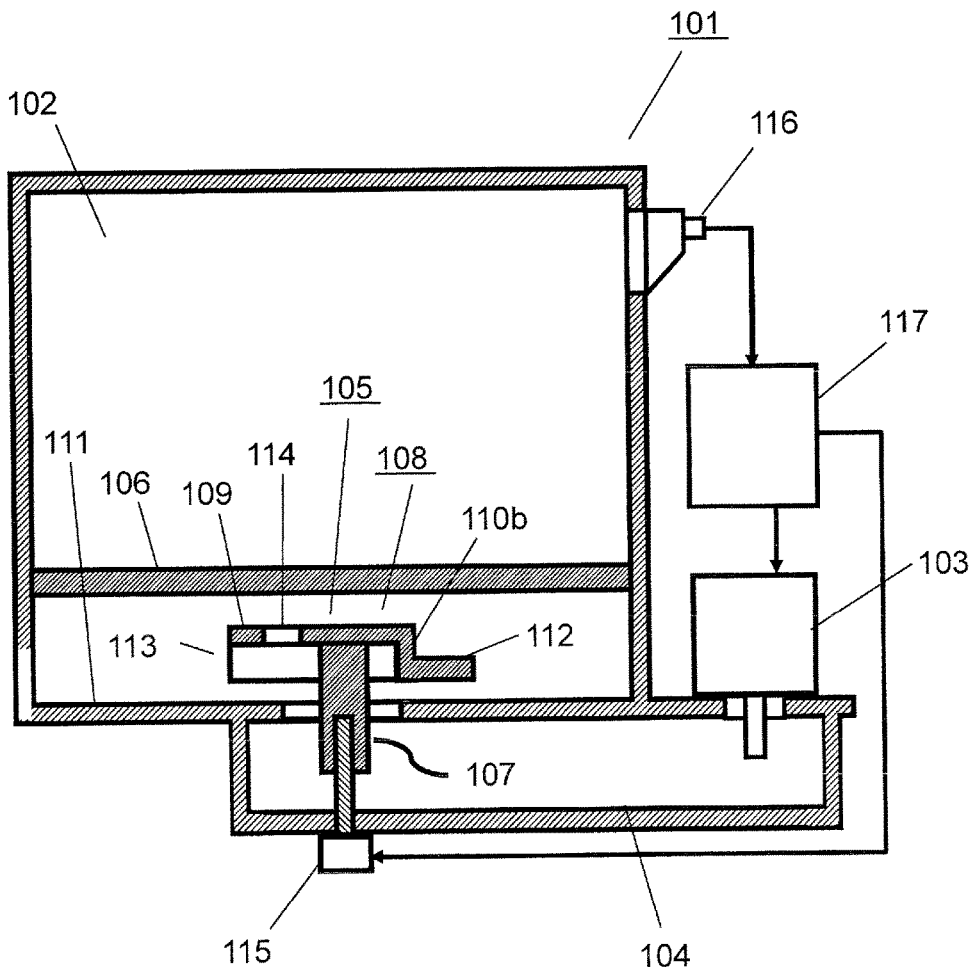
FIG. 1 is a cross-sectional front view of a microwave heating apparatus in a first embodiment of the present invention.

A first invention is a microwave heating apparatus including: a heating chamber which houses a heating object; a microwave generating unit which generates a microwave; a transmitting unit which transmits the microwave generated by the microwave generating unit; a waveguide-structure antenna which radiates to the heating chamber the microwave transmitted from the transmitting unit; and a rotation driving unit which drives the waveguide-structure antenna to rotate, wherein the waveguide-structure antenna has a microwave sucking-out opening in a wall surface forming a waveguide structure of the waveguide-structure antenna. Thus, microwave sucking-out effects from the microwave sucking-out opening can vary by presence/absence of a food near the microwave sucking-out opening, etc. Accordingly, controllability can be provided in a radial direction of the waveguide-structure antenna in teens of local heating performance of the waveguide-structure antenna so that the local heating can be performed depending on the position of the food.

A second invention is a microwave heating apparatus of the first invention, further including a coupling shaft which couples the microwave transmitted from the transmitting unit to the waveguide-structure antenna, wherein the waveguide-structure antenna has at its distal end a distal-end opening part opened to radiate the microwave coupled by the coupling shaft. Thus, the waveguide-structure antenna can radiate microwaves from both the distal-end opening part and the microwave sucking-out opening, thereby achieving more flexible microwave radiation.

A third invention is a microwave heating apparatus of the first invention or the second invention, wherein the microwave sucking-out opening sucks out a microwave according to a change in dielectric constant in the vicinity. Thus, changing the dielectric constant, for example, in accordance with the present/absence of placement of the heating object can suck out the microwaves.

A fourth invention is a microwave heating apparatus of any one of the first invention to the third invention, wherein a maximum length of the microwave sucking-out opening is ¼ or more and ½ or less of a wavelength of the microwave generated by the microwave generating unit. Thus, setting the size of the microwave sucking-out opening in this way can achieve an embodiment where no microwave is radiated from the microwave sucking-out opening when the heating object is not arranged in the heating chamber, while some microwaves can be radiated from the microwave sucking-out opening when the heating object is arranged in the heating chamber. Therefore, more efficient microwave radiation can be achieved.

A fifth invention is a microwave heating apparatus of any one of the first invention to the fourth invention, wherein the microwave sucking-out opening is offset from the center in a width direction of the wall surface and has a shape to radiate a circularly polarized microwave. Thus, radiating a microwave as the circularly polarized microwave leads to more uniform microwave radiation and also leads to enhanced sucking-out effects by the microwave sucking-out opening.

A sixth invention is a microwave heating apparatus of any one of the first invention to the fifth invention, wherein the microwave sucking-out opening has a shape of two crossing slits. Thus, a microwave can certainly be radiated as the circularly polarized wave, thereby radiating the microwave more uniformly.

A seventh invention is a microwave heating apparatus of any one of the first invention to the sixth invention, wherein a plurality of the microwave sucking-out openings are arranged in an extending direction of the waveguide-structure antenna. Thus, the microwave can be radiated more uniformly.

An eighth invention is a microwave heating apparatus of any one of the first invention to the seventh invention, further including a state-detecting unit which detects a state of the heating object in the heating chamber, wherein the rotation driving unit controls a rotational position of the waveguide-structure antenna based on the state of the heating object detected by the state-detecting unit.

A ninth invention is a microwave heating apparatus of any one of the first invention to the seventh invention, wherein the rotation driving unit controls a rotational position of the waveguide-structure antenna based on a predetermined program selectable by a user.

A tenth invention is a microwave heating apparatus of any one of the first invention to the ninth invention, wherein the microwave sucking-out opening is arranged only on one side relative to the center in the width direction of the wall surface. Thus, interference of microwaves radiated from the microwave sucking-out opening can be suppressed to perform more efficient microwave radiation.

An eleventh invention is a microwave heating apparatus of any one of the first invention to the ninth invention, wherein the microwave sucking-out openings are arranged on the both sides relative to the center in the width direction of the wall surface. Thus, microwaves can be sucked out from the both sides relative to the center in the width direction of the wall surface, thereby enabling to heat a heating object having a large area.

A twelfth invention is a microwave heating apparatus of the second invention, wherein the microwave sucking-out opening is arranged at a position closer to the coupling shaft than the distal-end opening part in an extending direction of the waveguide-structure antenna. Thus, the microwaves can intensively be sucked out around the coupling shaft, thereby heating the food more efficiently.

A thirteenth invention is a microwave heating apparatus of the second invention, wherein a microwave-radiating opening is formed at a position more distance from the coupling shaft than the microwave sucking-out opening in the wall surface forming the waveguide structure. Thus, "sucking out" the microwaves from the microwave sucking-out openings while "radiating" the microwaves from the microwave radiating opening leads to more flexible microwave radiation.

A fourteenth invention is a microwave heating apparatus of the second invention, wherein the distal-end opening parts and the microwave-radiating openings in the waveguide-structure antenna are both arranged on one side and the other side relative to the coupling shaft. Thus, the microwaves can be sucked out from both sides with respect to the coupling shaft, thereby radiating the microwaves more uniformly.

Preferable embodiments of the microwave heating apparatus according to the present invention will now be described with reference to the accompanying drawings. The microwave heating apparatus of the following embodiments will be described as microwave oven, which is exemplarily illustrated. The microwave heating apparatus of the present invention is not limited to the microwave oven and includes microwave heating apparatuses such as a heating apparatus, a garbage disposal machine, or a semiconductor manufacturing apparatus utilizing induction heating. The present invention is not limited to the specific configurations of the following embodiments and includes configurations based on the same technical concept.

First Embodiment

FIGS. 1 to 15 are explanatory views of a microwave heating apparatus in a first embodiment of the present invention.

Figure 2:
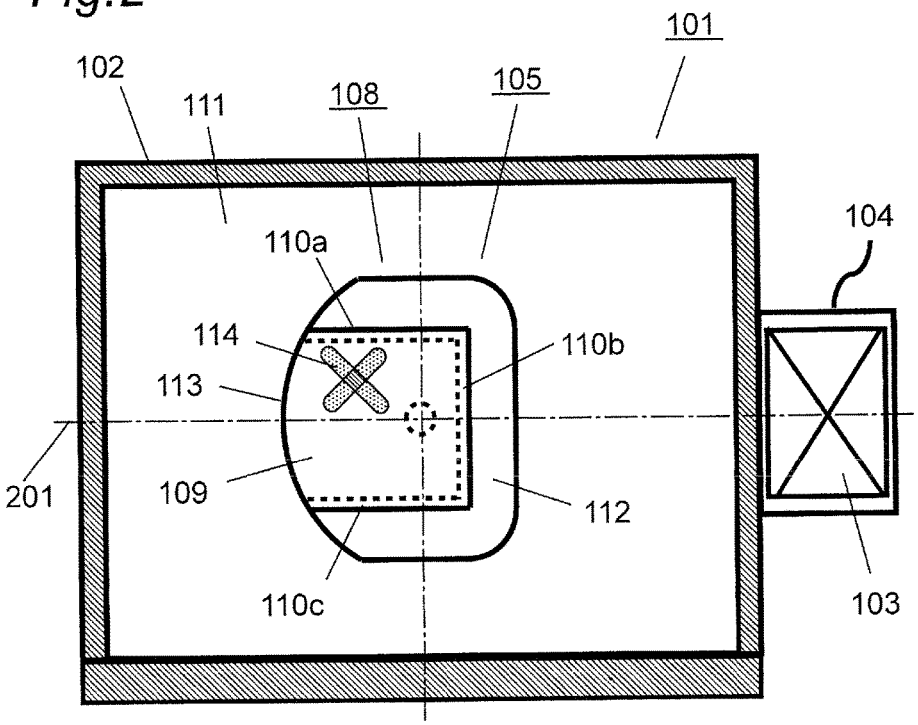
FIG. 2 is a cross-sectional plan view of the microwave heating apparatus in the first embodiment.

FIG. 1 is a cross-sectional view of the microwave heating apparatus viewed from the front side. FIG. 2 is a cross-sectional view of the microwave heating apparatus viewed from the above. As shown in FIGS. 1 and 2, a microwave oven 101 is a typical microwave heating apparatus and includes a heating chamber 102, a magnetron 103, a waveguide 104, a waveguide-structure antenna 105, and a table 106. The heating chamber 102 defines a space which is capable of housing a food (not shown) as a typical heating object. The magnetron 103 is an example of a microwave generating unit which generates a microwave. The waveguide 104 is an example of a transmitting unit which transmits (guides) the microwave generated (radiated) from magnetron 103 to the heating chamber 102. The waveguide-structure antenna 105 radiates the microwave from the waveguide 104 into the heating chamber 102. The table 106 is used for placing a food. The table 106 forms and covers an entire bottom surface of the heating chamber 102 so as not to expose the waveguide-structure antenna 105 into the heating chamber 102. An upper surface of the table 106 is made flat so that a user can easily put in and out a food and that the table 106 can easily be wiped when becoming dirty. The material of the table 106 is a material easily transmitting a microwave, for example, glass or ceramic. Such a material allows the microwave to be radiated from the waveguide-structure antenna 105 into the heating chamber 102.

The waveguide-structure antenna 105 can control a radiation direction of the microwave extracted from the waveguide 104 via a coupling shaft 107 into the heating chamber 102. The controlled radiation direction depends on a direction (orientation) of a box-shaped waveguide-structure 108 which surrounds the coupling shaft 107. Wall surfaces forming the waveguide-structure 108 include an upper wall surface 109, side wall surfaces 110*a*, 110*b*, 110*c*, and a flange 112. The upper wall surface 109 is connected to the coupling shaft 107. The side wall surfaces 110*a*, 110*b*, 110*c* close the waveguide-structure in three directions around the upper wall surface 109. The flange 112 is formed on the outside of the side wall surfaces 110*a*, 110*b*, 110*c* and in parallel with a heating chamber bottom surface 111 via a slight gap. The waveguide-structure 108 forms a distal-end opening part 113 widely opened only at a distal end in one remaining direction (not the three directions closed by the side wall surfaces 110*a*, 110*b*, 110*c*). The waveguide-structure 108 also defines a microwave sucking-out opening 114 in the upper wall surface 109. Such a configuration allows the waveguide-structure antenna 105 to radiate a large portion of microwaves from either the distal-end opening part 113 or the microwave sucking-out opening 114.

The microwave oven 101 also includes a rotation driving unit 115, an infrared sensor 116, and a control unit 117. The rotation driving unit 115 rotates and drives the waveguide-structure antenna 105 around the coupling shaft 107. The infrared sensor 116 is an example of a state-detecting unit which detects a state of a food. The infrared sensor 116 detects a temperature of a food as the state of the food. The control unit 117 provides oscillation control of the magnetron 103 and rotation control of the rotation driving unit 115 based on a signal of the infrared sensor 116, thereby controlling a rotational position of the waveguide-structure antenna 105.

In the first embodiment, the infrared sensor 116 to detect a temperature of a food is used as an example of the state-detecting unit, but the state-detecting unit is not limited thereto. For example, a weight sensor to detect a weight (a gravity center) of a food, an image sensor to obtain an image of a food, etc. may be used as the state-detecting unit. Alternatively, such a state-detecting unit may not be used. For example, a program selectable by a user may be stored in the microwave oven 101 and based on the predetermined program, the rotation driving unit 115 may control the rotational position of the waveguide-structure antenna 105.

The waveguide-structure 108 forms a substantially rectangular parallelepiped shape with the upper wall surface 109 and the side wall surfaces 110*a*, 110*b*, 110*c* and transmits a microwave in a direction (orientation) of the distal-end opening part 113 (a leftward direction in FIG. 2). The microwave sucking-out opening 114 is an opening having an X-shape of two long holes (slits or slots) crossing with each other. Disposing the microwave sucking-out opening 114 in a shifted position from the center in the width direction of the upper wall surface 109 of the waveguide can create/radiate a circularly polarized wave from the opening 114. Particularly, disposing the microwave sucking-out opening 114 only on one side in the width direction of the waveguide-structure 108 (the upper side in FIG. 2) can efficiently obtain the circularly polarized wave radiation. As shown in FIG. 2, the coupling shaft 107 is arranged at the center in both the longitudinal direction and the lateral direction of the heating chamber bottom surface 111.

Figure 3:
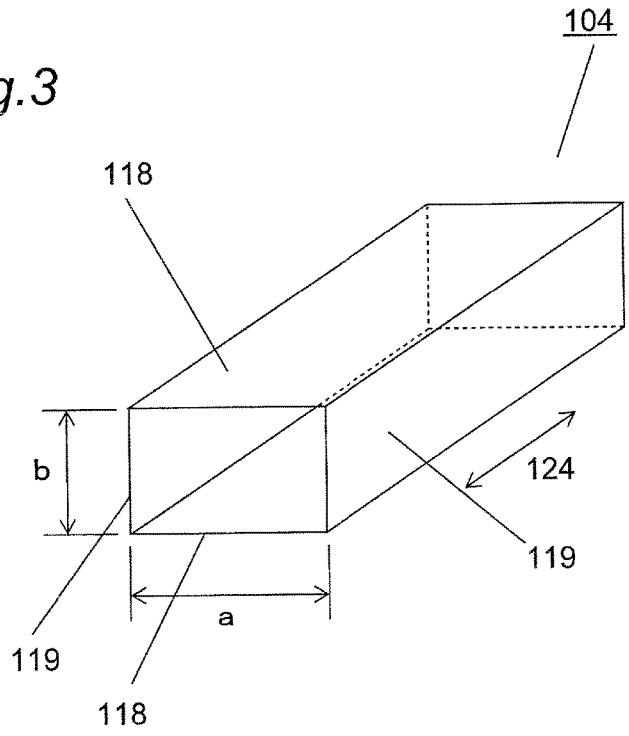
FIG. 3 is a view for explaining a waveguide.

For understanding of the waveguide-structure, a general waveguide 200 will be described with reference to FIG. 3. Most simple and general waveguide 200 is a rectangular waveguide of a rectangular parallelepiped shape formed by extending a constant rectangle cross section (having width "a" and height "b") in a transmission direction 124. It is known that when a wavelength of a microwave in a free space is $\lambda 0$, selecting the ranges of the width "a" and the height "b" of the waveguide 200 as $\lambda 0>a>\lambda 0/2$ and $b<\lambda 0/2$, respectively, will transmit the microwave in a TE10 mode.

The TE10 mode refers to a transmission mode in H wave (TE wave; electric transverse wave transmission, transverse electric wave) where only a magnetic field component without an electric field component exists in the transmission direction 124 of microwaves in the waveguide 200.

Before describing a guide wavelength $\lambda g$ in the waveguide 200, the free-space wavelength $\lambda 0$ will be described. The free-space wavelength $\lambda 0$ is known as about 120 mm in the case of a microwave of a general microwave oven. However, to be precise, the free-space wavelength $\lambda 0$ is obtained from $\lambda 0=c/f$. While "c" is the speed of light and constant at 3.0*10^8 [m/s], "f" is a frequency having a width of 2.4 to 2.5 [GHz] (ISM band). Since the oscillating frequency "f" varies depending on a variation and a load condition of the magnetron, the free-space wavelength $\lambda 0$ also varies. Therefore, the free-space wavelength $\lambda 0$ varies from the minimum value of 120 [mm] (at the time of 2.5 GHz) up to 125 [mm] (at the time of 2.4 GHz).

Returning to the waveguide 200, the width "a" and the height "b" of the waveguide 200 are often selected to be about 80 to 100 mm and 15 to 40 mm, respectively, in consideration of the range of the free-space wavelength $\lambda 0$. In this case, upper and lower wide planes of FIG. 3 are referred to as "H planes" 118, which mean planes with a magnetic field swirling in parallel, while left and right narrow planes are referred to as "E planes" 119, which mean planes parallel to an electric field. For reference, when a microwave is transmitted through a waveguide, a wavelength is represented as the guide wavelength $\lambda g$, which is obtained from $\lambda g=\lambda 0/\sqrt{(1-(\lambda 0/(2\times a))^2)}$. Although $\lambda g$ varies depending on the width "a" of the waveguide, but is determined independently of the height "b" of the waveguide. In the TE10 mode, the electric field is zero at both ends (the E planes) 119 in the width direction of the waveguide 200 while maximized at the center in the width direction.

The same concept can be applied to the waveguide-structure antenna 105 of the first embodiment shown in FIGS. 1 and 2. The upper wall surface 109 and the heating chamber bottom surface 111 are the H planes. The side wall surfaces 110*a* and 110*c* are the E planes. The side wall surface 110*b* is a reflection end for reflecting all the microwaves toward the distal-end opening part 113. Specifically, the waveguide-structure antenna 105 of the first embodiment has a waveguide width of 80 mm. The microwave sucking-out opening 114 are two orthogonal slits each having a length of 45 mm and a width of 10 mm. The microwave sucking-out opening 114 is arranged near the side wall surface 110*a* in the upper wall surface 109. As a result, the microwave sucking-out opening 114 occupies almost the half of the distance in the width direction of the upper wall surface 109 without crossing (traversing) a waveguide axis 201 (the center in the width direction of the waveguide H plane, generally referred to as "waveguide axis"). Disposing an X-shaped opening in an offset position from the center of the H plane of the waveguide to one side can radiate a fine circularly polarized wave. The rotation direction of the electric field differs depending on which side the X-shaped opening is offset to in the H-plane. The side the X-shaped opening is offset to in the H-plane determines a right-handed polarized wave or a left-handed polarized wave.

Figure 4A:
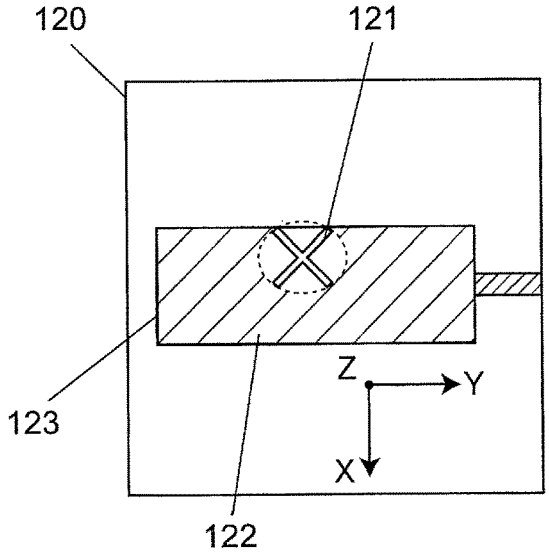
FIG. 4A is a plan view of a simulation model as a result of simulation where a terminal end portion of the waveguide is defined as a radiation boundary.
Figure 4B:
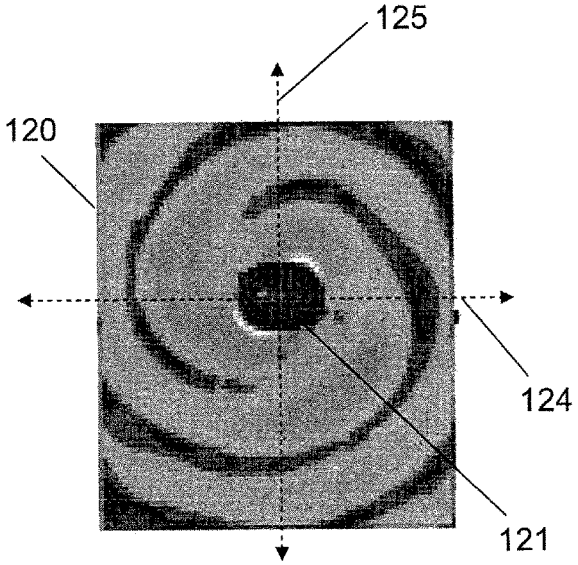
FIG. 4B is a cross-sectional plan view of an inside electric field intensity distribution as a result of simulation where the terminal end portion of the waveguide is defined as a radiation boundary.

A feature of the X-shaped opening radiating a circularly polarized wave will hereinafter be described. FIGS. 4 (4A and 4B) is a simulation result. Because this is a simulation, unlike the actual case, all the wall surfaces of the heating chamber 120 are defined as the radiation boundaries (boundary condition that a microwave is not reflected) in a simple configuration having only one X-shaped opening 121, and also a terminal end portion 123 of a waveguide 122 is defined as a radiation boundary. FIG. 4A shows a model shape viewed from above. FIG. 4B shows an analysis result by a contour diagram (contour map) of electric field intensity in the heating chamber 120 viewed from above.

Referring to FIG. 4B, the electric field whirls as a circularly polarized wave. Also, the electric field distribution seems to occur around the opening 121 uniformly in both a microwave transmission direction 124 (horizontal direction on the plane of FIG. 4B) and a width direction 125 of the waveguide 122 (vertical direction on the plane of FIG. 4B). As a result, the heating distribution can be made uniform by radiating circularly polarized microwaves from the opening 121.

Circular polarization will be explained. The circular polarization is a technique widely used in the fields of mobile communications and satellite communications. A familiar usage example is ETC (electronic toll collection system) "nonstop automatic toll receiving system" etc. A circularly polarized wave is a microwave having a polarization plane of an electric field rotating relative to a travelling direction depending on time. A circularly polarized wave is characterized in that the direction of the electric field continuously changes depending on time without a change in the amplitude of the electric field intensity. By applying the circular polarization to the microwave heating apparatus, it is expected that a heating object is uniformly heated particularly in the circumferential direction of the circularly polarized wave as compared to microwave heating using conventional linearly polarized waves. Although the circularly polarized waves are classified by a rotation direction into two types, i.e., a right-handed polarized wave (CW: clockwise) and a left-handed polarized wave (CCW: counterclockwise), either of the types may be available.

Although the circularly polarized wave may be formed by an opening of a waveguide wall surface or by a patch antenna, the microwave sucking-out opening 114 of the first embodiment is formed on the upper wall surface 109 (the H plane) of the waveguide-structure 108 to radiate the circularly polarized wave.

Since the circular polarization has been mainly utilized in communication fields and therefore intended for radiation to an open space, the circular polarization is typically discussed in terms of a so-called traveling wave with no returning reflection wave. On the other hand, the heating chamber 102 in the microwave oven 101 of the first embodiment is a closed space blocked from the outside, so a reflected wave may be generated in the heating chamber 102 and combined with a traveling wave to form a standing wave. However, a food absorbs a microwave thereby making the reflected wave smaller, and the standing wave is unbalanced by microwave radiation from the microwave sucking-out opening 114, so it is supposed that a traveling wave is generated until the unbalanced standing wave returns to a stable wave again. Therefore, forming the microwave sucking-out opening 114 into a shape capable of radiating a circularly polarized wave can utilize the feature of the circularly polarized wave described above and can make more uniform heating distribution in the heating chamber 102.

Several differences exist between a communication field in open space and a heating field in closed space, and therefore additional explanation will be made. In the communication field, since only necessary information is desirably transmitted/received by avoiding mixture with another microwave, a transmission side selects either the right-handed polarized wave or the left-handed polarized wave, and a reception side selects an optimum reception antenna in accordance with the polarized wave. On the other hand, in the heating field, since the microwave is absorbed by a heating object such as a food having no particular directivity instead of a reception antenna having directivity, it will be mainly important that microwaves are uniformly hit to the entire heating object. Therefore, whether the right-handed polarized wave or the left-handed polarized wave does not matter in the heating field, and a plurality of openings may be formed to mix the right-handed polarized wave and the left-handed polarized wave.

The microwave sucking-out opening 114 of the first embodiment will be hereinafter described with reference to FIGS. 5 to 15 to explain that when a heating object such as a food is close to the opening 114, the property of sucking out microwaves in the waveguide 104 (sucking-out effect) will be more excellent.

Figure 5A:
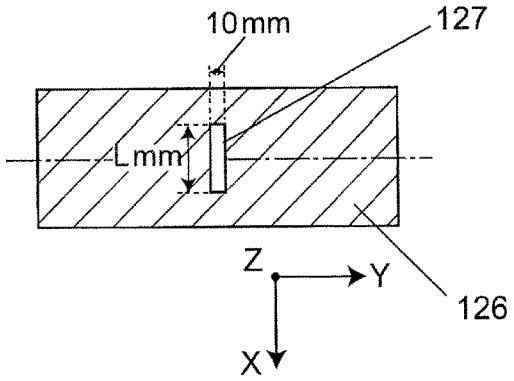
FIG. 5A is a cross-sectional plan view of a linear polarization simulation model regarding sucking-out effect.
Figure 5B:
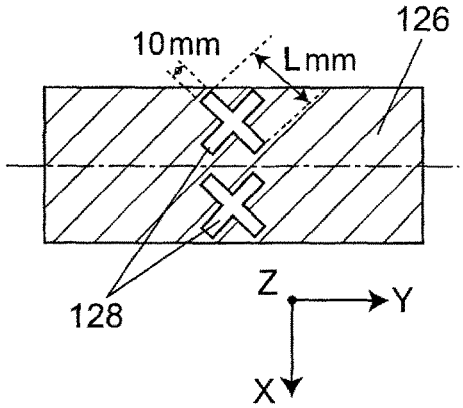
FIG. 5B is a cross-sectional plan view of a circular polarization simulation model regarding sucking-out effect.
Figure 5C:
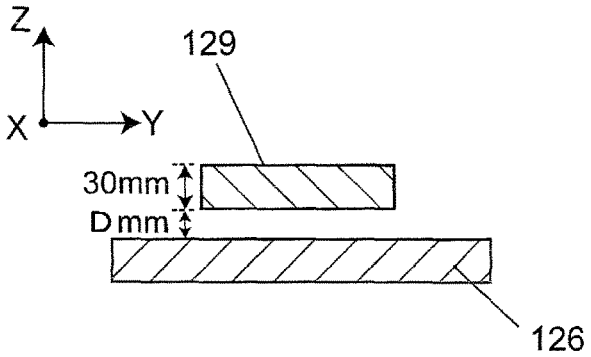
FIG. 5C is a cross-sectional front view of the simulation model regarding sucking-out effect.

First, the sucking-out effect will be described. A conventional linearly polarized wave and a circularly polarized wave of the first embodiment were compared by using CAE in terms of how many microwaves are radiated when a food is close to openings. Both FIGS. 5A and 5B are views from the above. FIGS. 5A and 5B show two waveguide configurations generating a conventional linearly polarized wave and a circularly polarized wave, respectively. FIG. 5C is a cross-sectional view from the front. As shown in FIG. 5A, an opening 127 to generate a linearly polarized wave has a linear shape across the waveguide axis, extending the both sides from the waveguide axis. As shown in FIG. 5B, two openings 128 to generate circularly polarized waves have X-shapes and are arranged symmetrically in the width direction. Each of the openings 127, 128 has a symmetrical shape in the width direction. Each of the openings 127, 128 has a slit width of 10 mm and a slit length of L mm. In this configuration, two cases were analyzed, one case where a food does not exist (without food) and another case where a food 129 exists as shown in FIG. 5C (with food). The case with food 129 shown in FIG. 5C was analyzed by using two types of area of the food 129, three types of material of the food 129, a height of the food 129 fixed to 30 mm, and a distance D from the opening surface of the waveguide 126 as parameters.

Figure 6A:
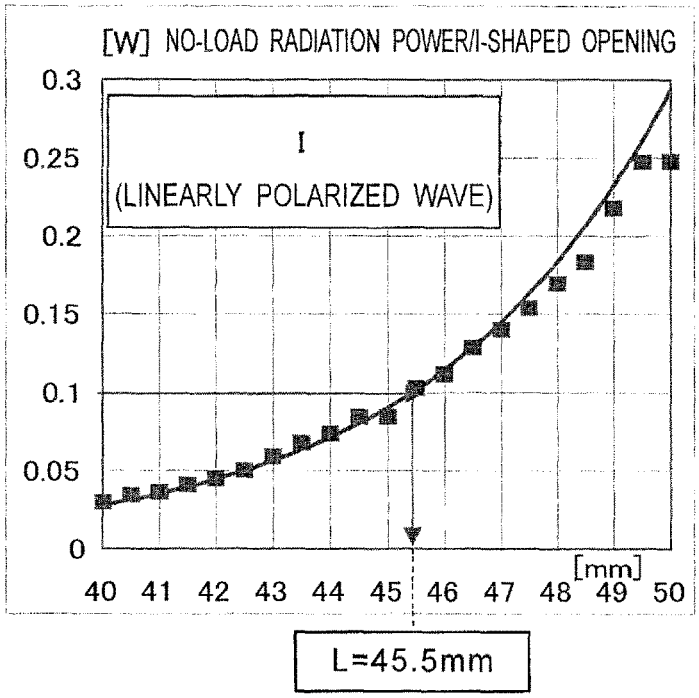
FIG. 6A is a characteristic diagram of linear polarization in terms of opening length and radiation power.
Figure 6B:
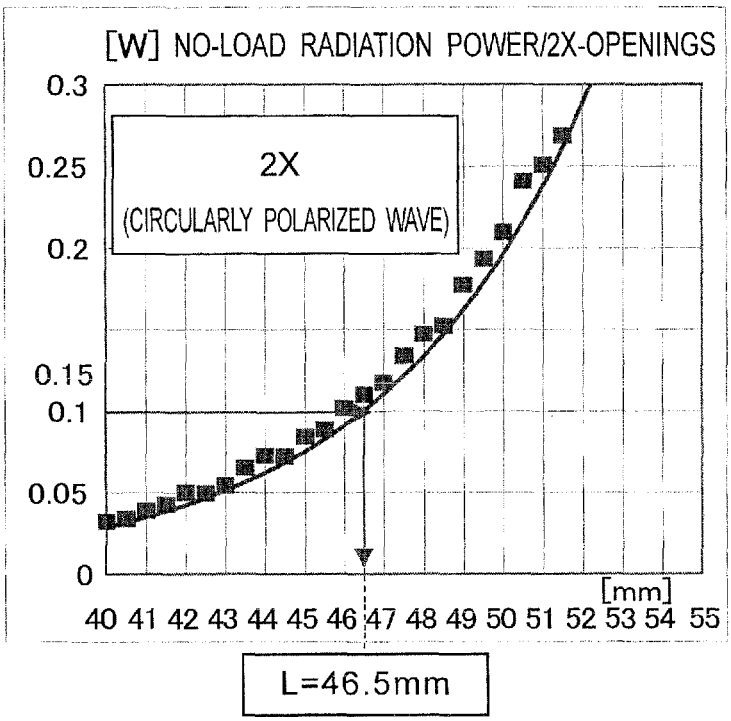
FIG. 6B is a characteristic diagram of circular polarization in terms of opening length and radiation power.

To set a radiation amount of microwaves in the case without food as a standard reference, changes in radiation amount without food with the opening length L are graphed in FIGS. 6A and 6B. FIG. 6A shows characteristics of the conventional linearly polarized waves from the opening 127 of FIG. 5A. FIG. 6B shows characteristics of the circularly polarized waves from the openings 128 of FIG. 5B. In FIGS. 6A and 6B, the horizontal axis indicates the opening length L and the vertical axis indicates a radiation amount radiated from the opening(s) when the value of the electric power transmitted in the waveguide 126 is assumed as "1".

From FIG. 6A, the opening length L of 45.5 mm was selected and, from FIG. 6B, the opening length L of 46.5 mm was selected. These opening lengths L were selected such that when no food was present, the same amount (1/10 of the electric power transmitted in the waveguide) would be radiated from the openings (corresponding to value "0.1" on the vertical axis of the graph).

Figure 7:
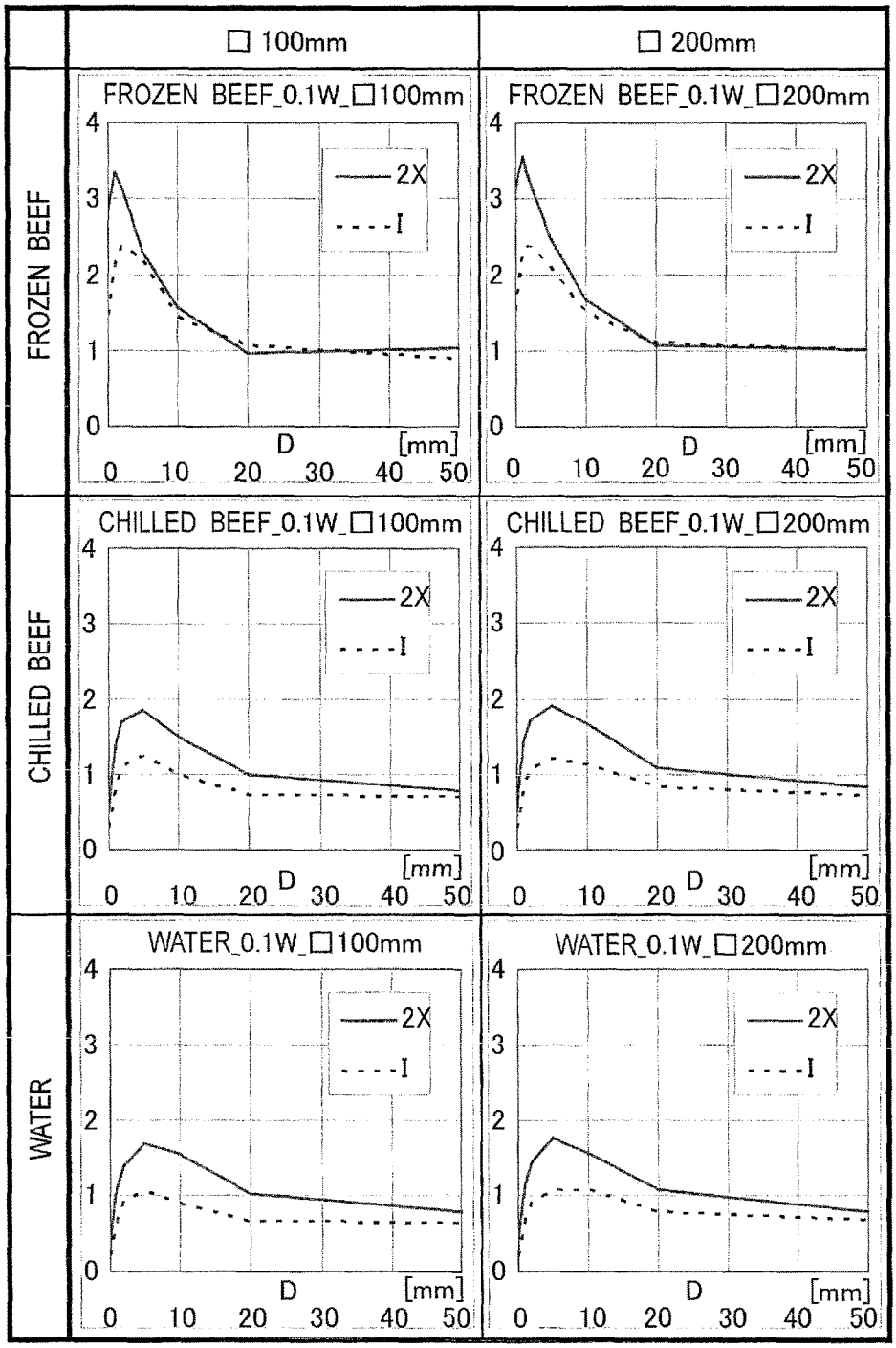
FIG. 7 is a characteristic diagram for comparing differences in the sucking-out effect depending on a polarization mode.

FIG. 7 shows summarized results of characteristics acquired from the analysis conducted with food, with applying the selected and fixed opening length "L". The analysis was conducted for three types of food (frozen beef, chilled beef, and water) and for two types of area of food (100 mm square and 200 mm square). The horizontal axis indicates a distance D from the food to the opening and the vertical axis indicates a relative radiation amount when the radiation amount without load is assumed as "1". Therefore, the graphs indicate how many times the radiation is increased when food is closely located (how much the food absorbs) as compared to when no food is present. The graphs include a broken line representative of the linearly polarized waves (caused by the I-shaped opening 127) and a solid line representative of the circularly polarized waves (caused by the two X-shaped openings 128). It was found that both the openings 127, 128 have a larger radiation amount in the case of the circularly polarized waves as compared to the linearly polarized waves, particularly, making twice radiation amount when the distance D is a practical distance of 20 mm or less. Therefore, it can be said that a circularly polarized wave has a higher sucking-out effect than a linearly polarized wave regardless of a type of food and an area of food.

Specifically examining, with regard to a type of food, particularly at the distance D of 10 mm or less, the frozen beef having small dielectric constant and dielectric loss makes larger sucking-out effect while the water having large dielectric constant and dielectric loss makes smaller sucking-out effect. In the cases of the chilled beef and the water, when the distance D becomes large, the radiation amount drops to one or less particularly in the linearly polarized waves. This will result from a fact that the microwaves reflected by the food returns to compensate for original microwaves.

The area of food is considered as having less impact on the sucking-out effect since almost no change is made in the radiation amount of microwaves between the 100 m square and the 200 mm square.

As described above, the X-shaped circular polarization openings 128 have the sucking-out effect higher than that of the I-shaped linear polarization opening 127. The reason will be discussed hereinafter.

A principle of generating the sucking-out effect will now be discussed. It is presumed that the sucking-out effect is probably related to a wavelength compression effect of a dielectric. The wavelength compression is generally known as a phenomenon that a wavelength of microwaves is compressed to $1/\sqrt{\varepsilon}$ times in an environment having a high dielectric constant $\varepsilon$. In other words, the wavelength compression due to a change in dielectric constant has the same meaning as expanding the size of the opening by a factor of $\sqrt{\varepsilon}$ under the same dielectric constant environment. Description regarding this matter will be made with reference to an image diagram of FIG. 8. The openings are classified into no opening, small opening, and large opening. The case of using air as a medium and the case of using a dielectric as a medium are separately considered.

Figure 8:
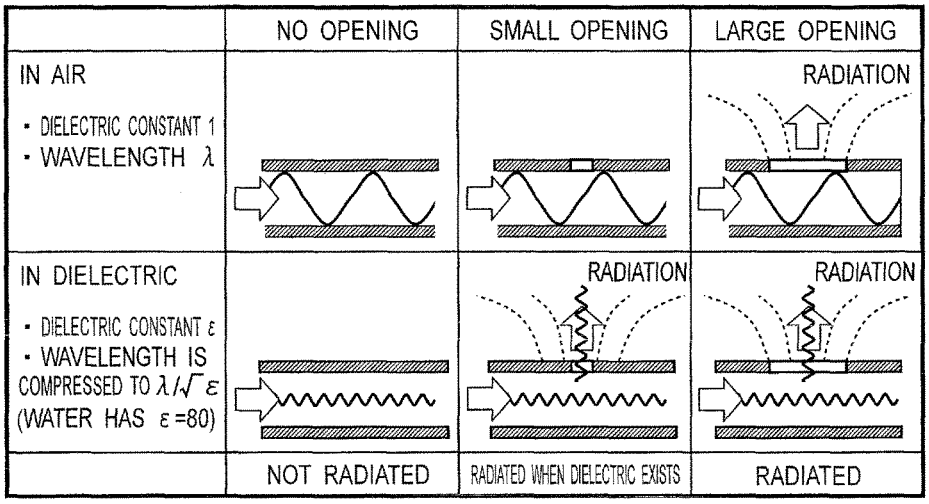
FIG. 8 is an image diagram of microwave radiation associated with wavelength compression and an opening size of a dielectric body.

It is assumed that when the entire system is in air, dielectric constant is 1 and the wavelength $\lambda$ is ≈120 mm. Then, as shown in FIG. 8, no microwave is radiated in the cases of no opening and small opening, while a microwave is radiated only in the case of large opening. In general, it is said that an opening length exceeding $\lambda/2$(≈60 mm) facilitates the radiation of microwaves. Therefore, setting the length of the small opening to $\lambda/4$ (≈30 mm) and the length of the large opening to $\lambda/2$ (≈60 mm), for example, can realize microwave radiation from the large opening without radiating a microwave from the small opening.

On the other hand, when the entire system is in a dielectric having the dielectric constant $\varepsilon$, the wavelength is compressed to $\lambda/\sqrt{\varepsilon}$ by the wavelength compression effect with the dielectric constant $\varepsilon$, and then an opening behaves as if expanded by a factor of $\sqrt{\varepsilon}$. Therefore, if the length of the small opening multiplied by $\sqrt{\varepsilon}$ has a dimension exceeding $\lambda/2$ (≈60 mm), a microwave can be radiated. For example, a microwave oven is known to heat water contained in food. Thus, when it is assumed that the dielectric is water, and a water's dielectric constant $\varepsilon=80$ and $\sqrt{\varepsilon}\approx 9$ are used, the small opening behaves as if the opening is expanded from 30 mm described above to 30×9270≈270 mm. As a result, the microwaves can be sufficiently radiated from the small opening.

It is noted that microwave is not radiated at any time in the case of no opening while radiated in the case of large opening regardless of the dielectric constant of the entire system. Only the case of small opening switches presence or absence of microwave radiation.

Figure 9:
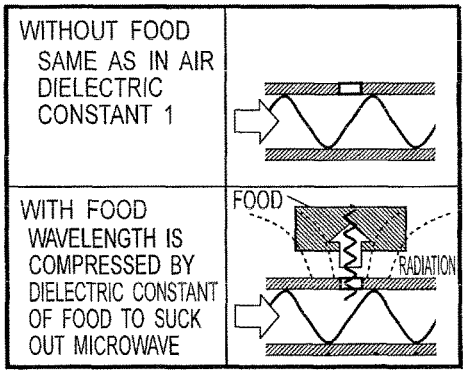
FIG. 9 is an image diagram of the microwave sucking-out effect caused by a food.

The concept of sucking-out effect developed from this fact will be described with reference to FIG. 9. This is a concept that even if the system is not entirely made of a dielectric, a kind of wavelength compression effect will occur by arranging a food, which acts as a dielectric, in a position close to an opening, thereby generating microwave sucking-out effect from the opening. First, it can be considered that around a small opening not radiating a microwave, an electromagnetic field has been charged, and if a dielectric comes close to the opening and then disturbs the charged electromagnetic field, microwaves will be immediately radiated. Therefore, as shown in FIG. 9, it can be considered that in the small opening not radiating a microwave without a food, the electromagnetic field charged near the small opening is disturbed with a food while the wavelength is compressed due to the dielectric constant of the food itself, resulting in microwave sucking-out. The food is directly heated by the sucked-out microwaves.

Figure 10:
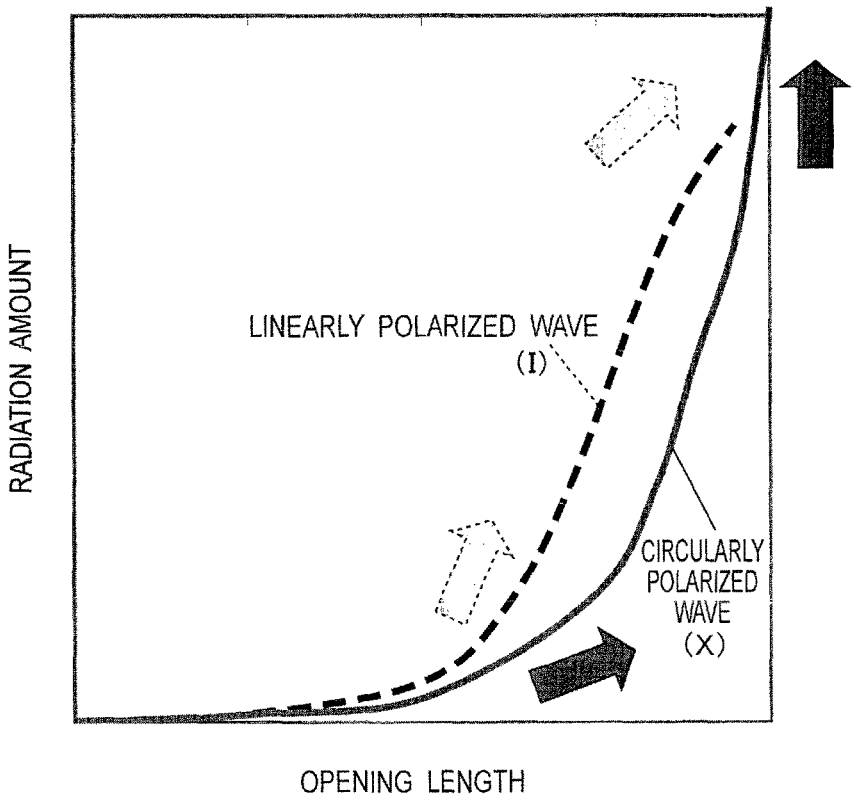
FIG. 10 is a characteristic diagram for comparing the opening length and the radiation amount between the polarization modes.

Next, the reason why the X-shaped circular polarization opening 128 has the higher sucking-out effect than that of the I-shaped linear polarization opening 127 will be discussed. FIG. 10 is a characteristic diagram obtained from the analysis result without food and representative of a relationship between the opening length and the radiation amount for the circular polarization and the linear polarization. It is the same in the both polarizations that when the opening length becomes longer, the radiation amount increases. However, the linear polarization rises earlier with an inclination gradually made smaller, while the circular polarization rises later at a larger inclination. Therefore, the circular polarization has a larger change rate (higher sensitivity) of the radiation amount relative to the linear polarization. Thus, even when the same food comes closer to the openings, the sucking-out effects differs between the X-shaped circular polarization opening 128 and the I-shaped linear polarization opening 127 so that a large amount can be sucked out from the X-shaped circular polarization opening 128.

In a similar way to the X-shape as shown in FIG. 10, shapes for circular polarization other than the X-shaped circular polarization opening were also checked.

Figure 11:
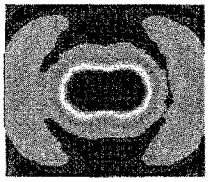
FIG. 11 is a diagram of a simulation result for examining polarized waves generated depending on an opening shape and its position.
Figure 11:
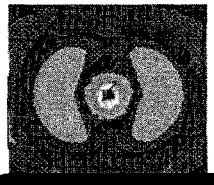
Figure 11:
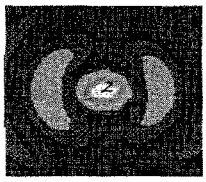
Figure 11:
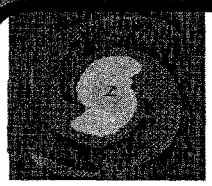
Figure 11:
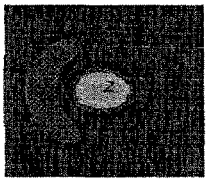
Figure 11:
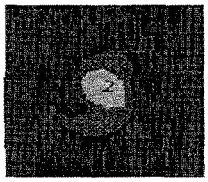
Figure 11:
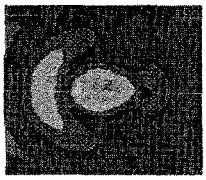
Figure 11:
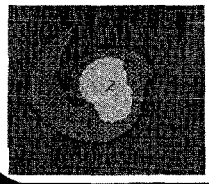

An opening shape for generating a circularly polarized wave is not limited to the X-shape. The same analysis as FIG. 4A-4B was conducted with applying various opening shapes to clarify the condition of opening capable of radiating a circularly polarized wave. The result is shown in FIG. 11. Four types of opening shapes were used, including a rectangle (square) and a circular shape in addition to the I-shape and the X-shape. Two types of opening positions were used, which are at the center of the width direction of the waveguide and near an edge in the width direction of the waveguide. If the opening position is at the center of the width direction of the waveguide, no whirling electric field occurs and thus no circularly polarized wave is generated in any opening. On the other hand, if the opening position is near an edge in the width direction of the waveguide, a whirling electric field occurs and thus a circularly polarized wave is generated except from the I-shape opening. This seems to be because that the I-shaped opening is elongated only in one direction and does not have an orthogonal long hole, thereby radiating only the linearly polarized waves regardless of its position. From the above, the conditions of generating a circularly polarized wave are found out in terms of opening position as a shifted position from the center in the width direction of the waveguide and in terms of opening shape as a shape including orthogonal long holes, respectively.

Figure 12:
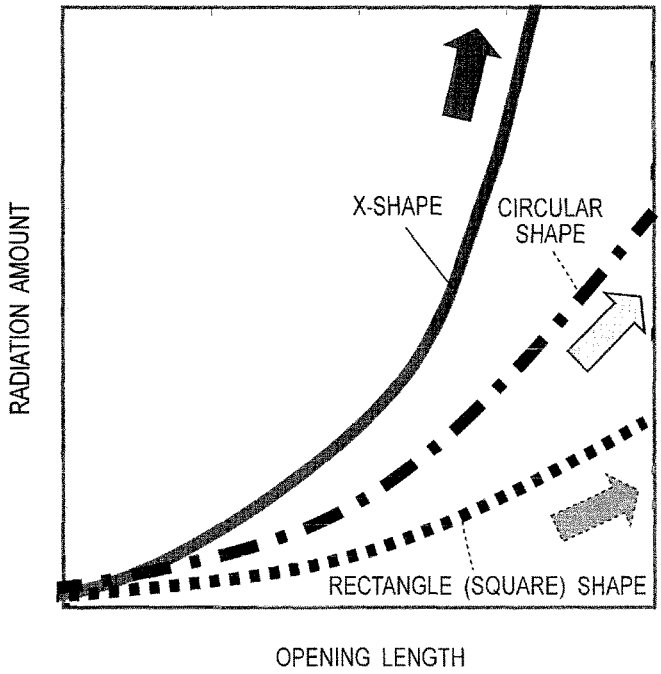
FIG. 12 is a characteristic diagram for comparing the opening length and the radiation amount among opening shapes to generate circular polarized waves.

Next, differences in the sucking-out effect among the three types of the opening shapes (X-shape, rectangle shape, and circular shape) capable of generating a circularly polarized wave will be described. FIG. 12 is a characteristic diagram obtained from the analysis result without food and representative of a relationship between the opening length and the radiation amount for the openings (X-shape, rectangle shape, and circular shape) capable of generating a circularly polarized wave. It is the same in all the opening shapes that when the opening length becomes longer, the radiation amount of microwaves increases. However, inclination of increase is significantly different. The descending order of the inclination is X-shape, the circular shape, and the rectangle (square) shape. That is, the descending order of the change rate (sensitivity) of the radiation amount relative to the opening length is X-shape, the circular shape, and the rectangle (square) shape accordingly. Although the rectangle shape as well as the circular shape contains an X-shape therein, it is considered that an extra shape of the openings excluding the X-shape will radiate various microwaves to be canceled with each other to reduce the overall radiation amount. On the other hand, it is considered that the X-shaped opening is made up only of a set of orthogonal components and therefore most efficiently generates the circularly polarized wave without unnecessary radiation. Thus, the X-shaped opening can most efficiently radiate the circularly polarized microwaves and will achieve the highest sucking-out effect.

Figure 13:
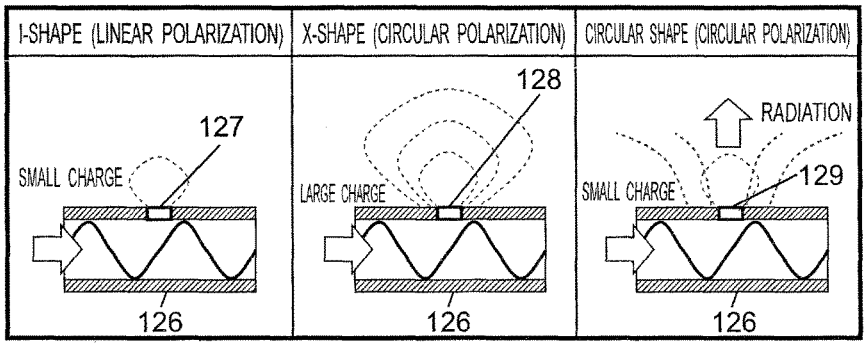
FIG. 13 is an image diagram of a charge amount of an electromagnetic field depending on an opening shape.

As a final of the analysis, a relationship of the sucking-out effect between the number of slits and the electromagnetic field charge amount will be discussed. FIG. 13 depicts three types of openings (I-shape, X-shape, circular shape) with an image of the charge amount above the openings. The opening shapes of three types includes the I-shaped opening 127 consisting of one slit for radiating a linearly polarized wave, the X-shaped opening 128 consisting of two orthogonal slits for radiating a circularly polarized wave, and the circular opening 129 containing many orthogonal slits for radiating a circularly polarized wave. The I-shaped opening 127 has a small charge amount and the X-shaped opening 128 has the largest charge amount. The circular opening 129 has a small charge amount because of having some radiation to be cancelled with each other. Thus, the charge amount differs depending on an opening shape. When food comes close to the opening, this acts as if the dielectric constant increases in the surroundings and the wavelength compression occurs. As a result, the opening length acts as if extended, and thus the radiation amount drastically increases in the X-shaped opening 128 having the high sensitivity to the opening length, resulting in the extremely high sucking-out effect from the waveguide 126. Returning to FIGS. 6A and 6B, no significant difference was present between the linear polarization shape (I-shape) consisting of one slit and the circular polarization shape (X-shape) consisting of two slits regarding the opening length capable of generating the same radiation amount without a load (that is, there is no more than a slight difference of 1 mm between 45.5 mm of I-shape and 46.5 mm of X-shape). Although the X-shape has an opening area about four times larger than that of I-shape, the radiation amount is the same. This leads to a speculation that the X-shaped opening 128 may have a large charge amount unable to be radiated.

Figure 14:
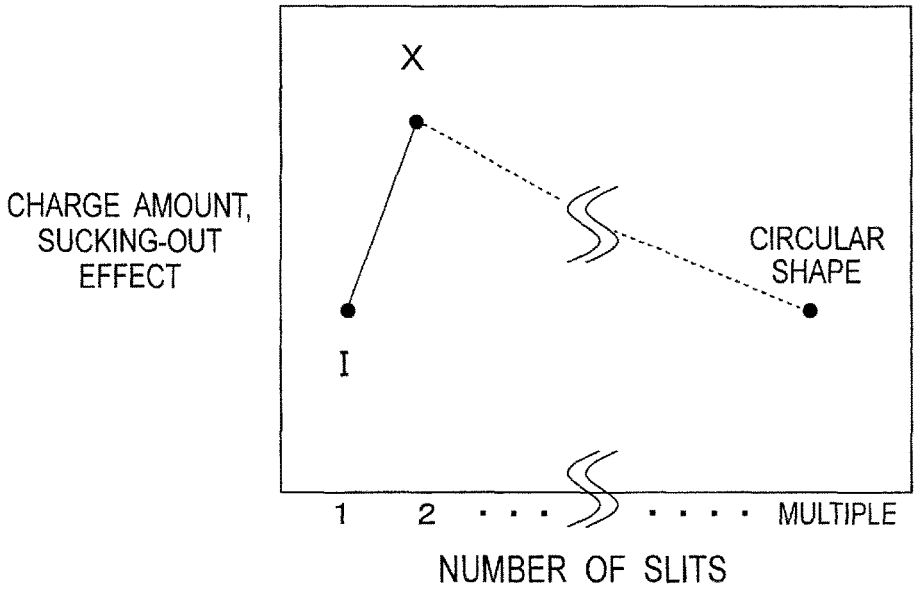
FIG. 14 is an image diagram of the charge amount or the sucking-out effect relative to the number of slits.

Based on the above description, FIG. 14 depicts an image of the charge amount or the sucking-out effect relative to the number of slits. The sucking-out effect is small in the case of one slit, but will be doubled in the case of two slits, achieving the maximum value of the sucking-out effect in the graph. Subsequently, the sucking-out effect will be reduced as the slits are increased.

Figure 15A:
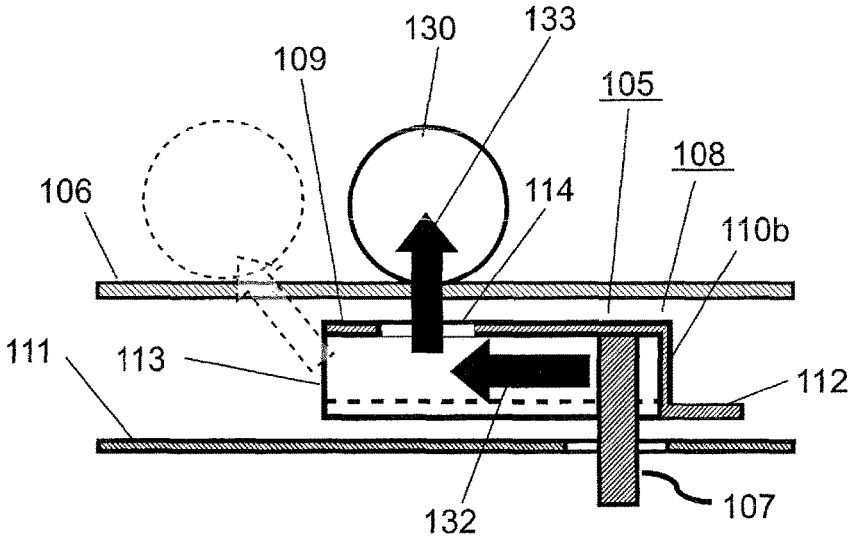
FIG. 15A is a cross-sectional front view of a microwave heating apparatus showing a practical image of the sucking-out effect, where a food is on the opening to suck out microwaves.
Figure 15B:
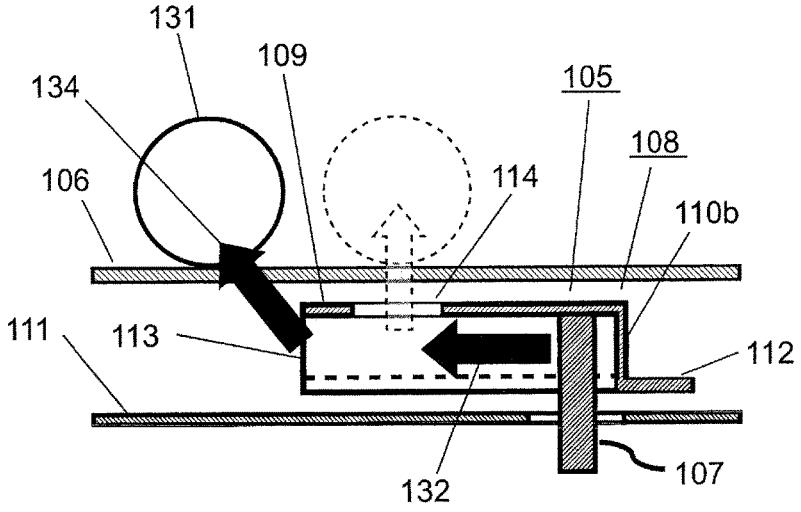
FIG. 15B is a cross-sectional front view of a microwave heating apparatus showing a practical image of the sucking-out effect, where no food is on the opening to suck out microwaves.

FIGS. 15A and 15B depict a practical example of the sucking-out effect in the first embodiment. FIGS. 15A and 15B both depict foods 130, 131 placed on the left side with respect to the coupling shaft 107, but the distances from the coupling shaft 107 are different. The food 130 of FIG. 15A is positioned close to the coupling shaft 107, while the food 131 of FIG. 15B is positioned distant from the coupling shaft 107. In both cases, the rotation driving unit 115 for driving the coupling shaft 107 is controlled by the control unit 117 such that the distal-end opening part 113 of the waveguide-structure antenna 105 faces to the left side in FIGS. 15A and 15B. In FIG. 15A, the food 130 is positioned close to the microwave sucking-out opening 114 and, therefore, the sucking-out effect is generated. Thus, a large portion of microwaves 132 traveling from the coupling shaft 107 toward the distal-end opening part 113 is sucked out from the opening 114 toward the food 130 as microwaves 133, locally heating the food 130 as direct waves. In FIG. 15B, the food 131 is distant from the microwave sucking-out opening 114 and, therefore, the sucking-out effect may not be generated. Thus, a large portion of the microwaves 132 traveling from the coupling shaft 107 toward the distal-end opening part 113 is radiated from the distal-end opening part 113 toward the food 131 as microwaves 134, locally heating the food 130 as direct waves. As described above, the microwave sucking-out opening 114 can have controllability such that the microwave radiation amount increases only when a food is placed near the microwave sucking-out opening 114 while the microwave radiation amount decreases when a food is placed distant from the opening 114.

The above description about the sucking-out effect relates to sucking out a portion of microwaves transmitted through the waveguide by an opening, showing that a circular polarization opening, particularly an X-shaped opening, arranged in a wall surface of a waveguide has the high sucking-out effect. However, the sucking-out effect will not be expected if a circularly polarized wave is radiated by using a so-called patch antenna which has no waveguide-structure and supplies electricity directly to a flat plate. This is because even when food is brought closer to the patch antenna, only a matching will be changed mainly and it is obvious that no microwave is sucked out from the patch antenna.

Operation and effect of the first embodiment will be described hereinafter.

As shown in FIGS. 1 and 2, the microwave oven 101 of the first embodiment includes the heating chamber 102 which houses a food (a heating object), the magnetron (a microwave generating unit) 103 which generates a microwave, the waveguide (a transmitting unit) 104 which transmits the microwave generated by the magnetron 103, the waveguide-structure antenna 105 which radiates to the heating chamber 102 the microwave transmitted from the waveguide 104, and the rotation driving unit 115 which drives the waveguide-structure antenna 105 to rotate. The microwave sucking-out opening 114 is formed in a wall surface forming the waveguide-structure 108 of the waveguide-structure antenna 105. When the food is located closer, the microwave sucking-out opening 114 has the property of sucking out microwaves in the waveguide-structure 108 (that is, sucking-out effect). Therefore, the controllability can be provided such that when the food 130 is placed close to the microwave sucking-out opening 114, the microwave radiation amount is increased for local heating and when the food 130 is placed distant from the microwave sucking-out opening 114, the microwave radiation amount from the microwave sucking-out opening 114 is reduced. Thus, the controllability can be provided also in the radial direction of the waveguide-structure antenna 105 in terms of the local heating performance of the waveguide-structure antenna 105 in accordance with the positional relationship between the microwave sucking-out opening 114 and the food, so that the local heating can be performed depending on a position of the food.

The microwave oven 101 of the first embodiment further includes the coupling shaft 107 which couples the microwave transmitted from the waveguide 104 (the transmitting unit) to the waveguide-structure antenna 105, wherein the waveguide-structure antenna 105 has at its distal end the distal-end opening part 113 opened to radiate the microwave coupled by the coupling shaft 107. As a result, the waveguide-structure antenna 105 can radiate microwaves from both the distal-end opening part 113 and the microwave sucking-out opening 114, thereby achieving more flexible microwave radiation. More specifically, when the food is placed near the coupling shaft 107 from the microwave sucking-out opening 114, the food is located closer to the microwave sucking-out opening 114 than the distal-end opening part 113. In this case, microwaves are radiated from the microwave sucking-out opening 114 and the food can locally be heated by direct waves from the microwave sucking-out opening 114. On the other hand, when the food is placed at an outside position from the distal-end opening part 113, the food is located distant from the microwave sucking-out opening 114. In this case, microwaves are hardly radiated from the microwave sucking-out opening 114 and, instead, the food can locally be heated by direct waves from the distal-end opening part 113 located close to the food. Next, when the food is placed between the microwave sucking-out opening 114 and the distal-end opening part 113, the microwaves can be radiated from the distal-end opening part 113 to some extent without completely radiating the microwaves from the microwave sucking-out opening 114, thereby locally heating the food from both. In this case, the food is heated from both near the center and near the edge, thereby achieving uniform heat distribution of the food. As described above, the controllability can be provided also in the radial direction of the waveguide-structure antenna 105 in terms of the local heating performance of the waveguide-structure antenna 105 in accordance with the position of the food relative to the microwave sucking-out opening 114 and the distal-end opening part 113, so that the local heating can be performed depending on the position of the food.

According to the microwave oven 101 of the first embodiment, the microwave sucking-out opening 114 sucks out a microwave according to a change in dielectric constant in the vicinity. Thus, changing the dielectric constant, for example, in accordance with the present/absence of placement of the heating object can suck out the microwaves.

According to the microwave oven 101 of the first embodiment, the maximum length of the microwave sucking-out opening 114 is ¼ or more and ½ or less of the wavelength of the microwave generated by the magnetron 103 (the microwave generating unit). Setting the size of the microwave sucking-out opening 114 in this way can achieve an embodiment where no microwave is radiated from the microwave sucking-out opening 114 when the heating object is not arranged in the heating chamber 102, while some microwaves can be radiated from the microwave sucking-out opening 114 when the heating object is arranged in the heating chamber 102. Therefore, more efficient microwave radiation can be achieved.

According to the microwave oven 101 of the first embodiment, the microwave sucking-out opening 114 is offset from the center in the width direction of the wall surface and has a shape to radiate a circularly polarized microwave. Therefore, as compared to a conventional opening arranged at a center of a wall surface to radiate a linearly polarized wave, microwave radiation from the microwave sucking-out opening 114 can be more difficult when no food is closely located, and thus the property (the sucking-out effect) of sucking out microwaves in the waveguide-structure 108 can be more enhanced when the food is located closer. As a result, the controllability of the microwave radiation can be enhanced.

According to the microwave oven 101 of the first embodiment, the microwave sucking-out opening 114 has a shape of two crossing slits. Thus, a microwave can certainly be radiated as a circularly polarized wave, thereby radiating the microwaves more uniformly.

According to the microwave oven 101 of the first embodiment, the microwave sucking-out opening 114 is arranged only on one side relative to the center in the width direction of the wall surface. Therefore, interference of microwaves radiated from the microwave sucking-out opening 114 can be suppressed to perform more efficient microwave radiation.

The microwave oven 101 of the first embodiment also may include the state-detecting unit (such as the infrared sensor 116) which detects a state of the heating object (food) in the heating chamber 102, wherein the rotation driving unit 115 may control the rotational position of the waveguide-structure antenna 105 based on the state of the heating object detected by the state-detecting unit. Alternatively, the rotation driving unit 115 may control the rotational position of the waveguide-structure antenna 105 based on a predetermined program selectable by a user.

The size of the microwave sucking-out opening 114 may be optimized according to a distance in the vertical direction between the microwave sucking-out opening 114 and the food. For example, if the distance in the vertical direction from the microwave sucking-out opening 114 to the upper surface of the table 106 is 7 to 10 mm, the length of the slits may be set to $\lambda/4$ (≈30 mm) or more and $\lambda/2$ (≈60 mm) or less to perform more efficient microwave radiation.

Second Embodiment

Figure 16:
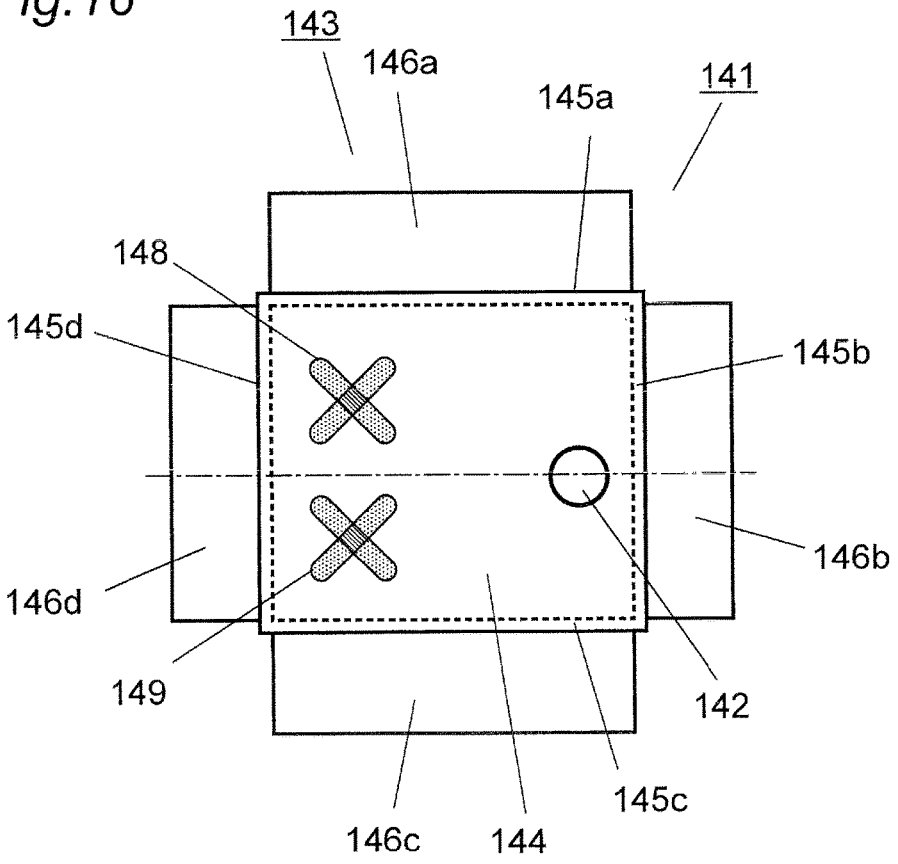
FIG. 16 is a plan view of a waveguide-structure antenna in a second embodiment of the present invention.

FIG. 16 depicts a configuration of a waveguide-structure antenna of a microwave heating apparatus according to a second embodiment of the present invention viewed from above. Explanation of the constituent elements and functions equivalent to those of the first embodiment will be omitted, and thus those different from the first embodiment will be mainly described.

A waveguide-structure antenna 141 can control a radiation direction of the microwaves pulled out via a coupling shaft 142 from inside the waveguide into the heating chamber, depending on a direction of a box-shaped waveguide-structure 143 which surrounds the coupling shaft 142. Wall surfaces forming the waveguide-structure 143 include an upper wall surface 144, side wall surfaces 145*a*, 145*b*, 145*c*, 145*d*, and flanges 146*a*, 146*b*, 146*c*, 146*d*. The upper wall surface 144 is connected to the coupling shaft 142. Four directions around the upper wall surface 144 are closed by the side wall surfaces 145*a*, 145*b*, 145*c*, 145*d*. The flanges 146*a*, 146*b*, 146*c*, 146*d* are formed on the outside of the side wall surfaces 145*a*, 145*b*, 145*c*, 145*d* and in parallel with the heating chamber bottom surface via a slight gap. The waveguide-structure antenna 141 of the second embodiment does not have an opened distal-end opening part. The upper wall surface 144 has microwave sucking-out openings 148, 149 on the both sides relative to a waveguide axis passing through the coupling shaft 142.

As described above, according to the microwave heating apparatus of the second embodiment, the microwave sucking-out openings 148, 149 are arranged on the both sides relative to the center in the width direction of the wall surface. As a result, microwaves can be sucked out from the both sides relative to the center in the width direction of the wall surface, thereby enabling to heat a heating object having a large area.

Other Embodiments

FIGS. 17 to 34 are explanatory views of microwave heating apparatuses according to other embodiments of the present invention.

Figure 17:
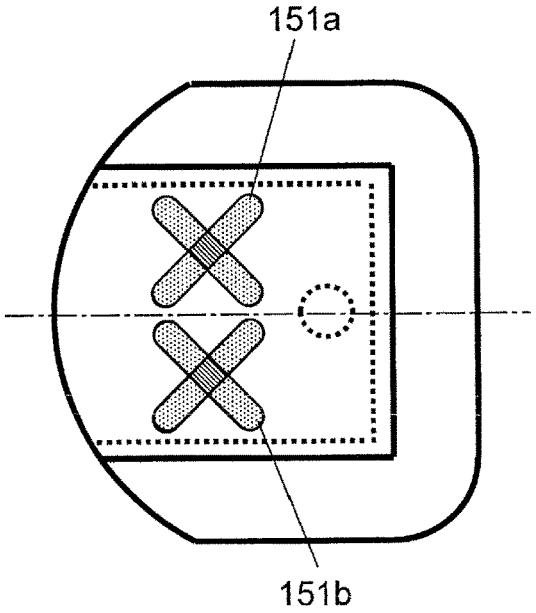
FIG. 17 is a plan view of a waveguide-structure antenna in other embodiment of the present invention.

In FIG. 17, two microwave sucking-out openings 151*a*, 151*b* are arranged in the width direction of the waveguide, thereby providing the controllability in the width direction and enabling local heating of a food having a large area in the width direction by wide-range radiation. In particular, since the microwave sucking-out openings 151*a*, 151*b* arranged on the both sides relative to the center in the width direction of the wall surface, the microwaves can be sucked out from the both sides relative to the center in the width direction of the wall surface, thereby enabling to heat a heating object having a large area.

Figure 18:
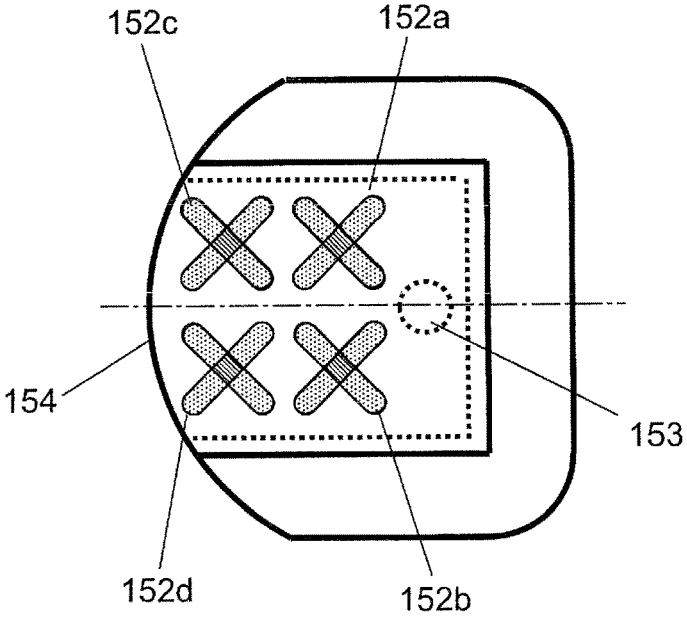
FIG. 18 is a plan view of a waveguide-structure antenna in other embodiment of the present invention.

In FIG. 18, four microwave sucking-out openings 152*a*, 152*b*, 152*c*, 152*d* are arranged. The microwave sucking-out openings 152*a*, 152*b* on a first row and the microwave sucking-out openings 152*c*, 152*d* on a second row are located between a coupling shaft 153 and a distal-end opening part 154. This two-row arrangement of the microwave sucking-out openings has an effect of further improving the controllability as compared to the case of the aforementioned single-row arrangement. In particular, disposing a plurality of the microwave sucking-out openings 152*a*, 152*b*, 152*c*, 152*d* along the extending direction of the waveguide-structure antenna can achieve more desirable local heating. Although depending on the size of the heating chamber, a smaller size and a larger number of the microwave sucking-out openings may enhance the controllability.

Figure 19:
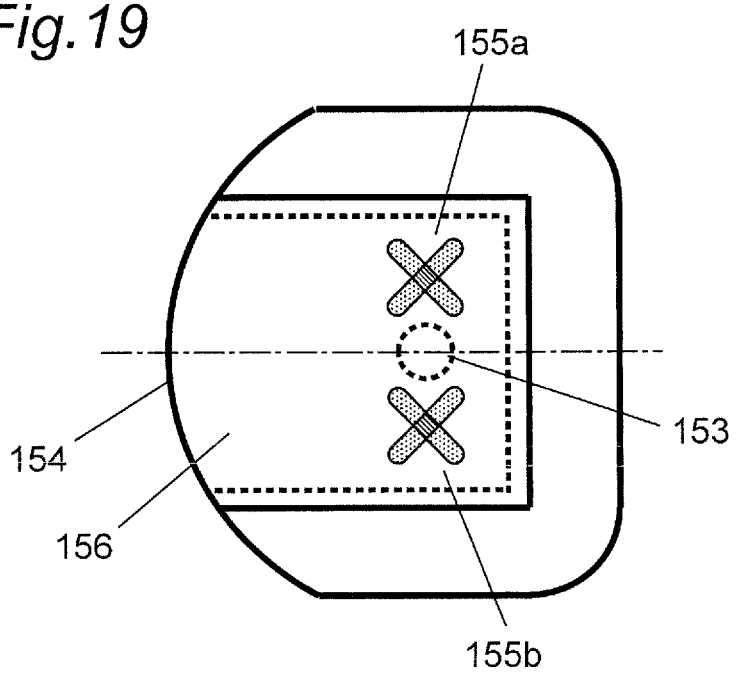
FIG. 19 is a plan view of a waveguide-structure antenna in other embodiment of the present invention.

In FIG. 19, microwave sucking-out openings 155*a*, 155*b* are arranged beside a coupling shaft 153. A food is normally placed at the center of the heating chamber and the coupling shaft 153 is often arranged at the center of the heating chamber. In this case, the food placed at the center of the heating chamber is likely to be on the microwave sucking-out openings 155*a*, 155*b* laterally adjacent to the coupling shaft 153, thereby producing more microwave sucking-out effect. In particular, since the microwave sucking-out openings 155*a*, 155*b* are arranged at the positions closer to the coupling shaft 153 than the distal-end opening part in the extending direction of the waveguide-structure antenna, the microwaves can intensively be sucked out around the coupling shaft 153, thereby heating the food more efficiently. The food can strongly be heated at the center of the bottom surface by direct waves, thereby increasing the heating efficiency. Particularly, since the microwaves are radiated via the microwave sucking-out openings 155*a*, 155*b* at extremely short distances from the coupling shaft 153, a path of an electric current on an upper wall surface 156 flowing through a conductor portion between the coupling shaft 153 and the microwave sucking-out openings 155*a*, 155*b* is shortened, thereby reducing a conduction loss and thus further improving the heating efficiency.

Figure 20:
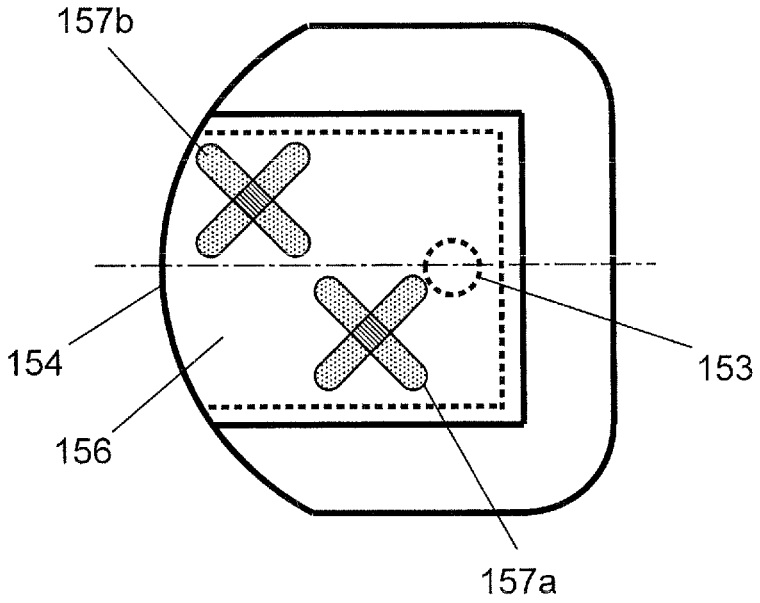
FIG. 20 is a plan view of a waveguide-structure antenna in other embodiment of the present invention.

In FIG. 20, microwave sucking-out openings 157*a*, 157*b* are arranged in a staggered manner on the upper wall surface 156. This produces the effect of reducing microwave interference with each other as compared to the case of disposing a plurality of the microwave sucking-out openings along the width direction of the upper wall surface as shown in FIGS. 17 and 18. More specifically, if two microwave sucking-out openings 157*a*, 157*b* are arranged along the width direction and then a food larger than the width of the upper wall surface 156 is placed, the microwaves transmitted from the coupling shaft 153 toward the distal-end opening part 154 are distributed to the two microwave sucking-out openings 157*a*, 157*b*. The microwaves radiated from the two microwave sucking-out openings 157*a*, 157*b* may interfere with each other before being applied to the food. On the other hand, in the case of staggered arrangement as in this embodiment, a distance between the openings can be increased and thus the microwave interference with each other can be reduced as compared to the case where the openings are adjacent in the width direction or adjacent in the transmission direction. Therefore, desired local heating can be performed.

FIG. 21 depicts a configuration of a microwave sucking-out opening 158 crossing the center (a waveguide axis 159) in the width direction of the upper wall surface 156. As a result, the opening length of the microwave sucking-out opening can be made longer and, therefore, an amount of the sucked-out microwaves can be increased. To maintain the circular polarization of the microwaves sucked out and radiated from the opening, the center of the microwave sucking-out opening may be at least slightly shifted (offset)

since the linearly polarized waves are generated if the center of the microwave sucking-out opening completely matches the waveguide axis 159 as shown in FIG. 11.

FIG. 22 depicts various shape variations of the microwave sucking-out opening. FIGS. 22(*a*) and 22(*b*) depict examples having a high sucking-out effect as shown in FIGS. 12 to 14 among the various shapes of the microwave sucking-out openings (i.e., examples including only a small number of orthogonal slits). The various shapes include, in addition to X-shape of FIG. 22(*a*) as well as a T-shape of FIG. 22(*b*), an L-shape of FIG. 22(*c*), a three-slit shape as shown in FIG. 22(*d*), and partially-separated shapes as shown in FIGS. 22(*e*) and 22(*f*). Including only a small number of orthogonal slits as in the configurations described above can enhance the microwave sucking-out effect particularly.

FIG. 23 depicts an example of non-orthogonal slits of microwave sucking-out openings 160*a*, 160*b*. More specifically, the shapes of the microwave sucking-out openings 160*a*, 160*b* are short in the width direction of the upper wall surface 156 and long in the transmission direction. As described with reference to FIG. 3, the width "a" of the upper wall surface 156 may be selected in the range of $\lambda 0>a>\lambda 0/2$ to allow the waveguide-structure antenna to act as a waveguide. Therefore, the distance from the waveguide axis to the end portions in the width direction is a/2 in the waveguide-structure antenna and, thus, the opening length L of the orthogonal slit shape has an upper limit not crossing the waveguide axis. More specifically, the opening length "Lmax" as the upper limit is $\approx a/\sqrt{2}(=\sqrt{2}\cdot a/2)$. In the case of a=80, Lmax≈56 is obtained. The opening width is not considered in this calculation but, actually, the opening length may further be reduced as the opening width is made wider. In the first embodiment, the opening width is 10 mm and the opening length is L=45 mm. Although the examples regarding orthogonal slits (at the crossing angle of 90°) have been mainly described, the microwave sucking-out effect is actually achieved with circularly polarized waves generated to some extent even when the slits are not orthogonal and have a narrow crossing angle of 60° (that is, a wide crossing angle of 120°). Therefore, forming the opening shape into a shape shortened in the width direction of the upper wall surface and elongated in the transmission direction leads to longer opening length without crossing the waveguide axis 159. Applying such a shape enables adjustment, for example, widening an area of the opening for contributing to the sucking-out effect, or increasing a radiation amount of microwaves sucked out from the opening.

Figure 24:
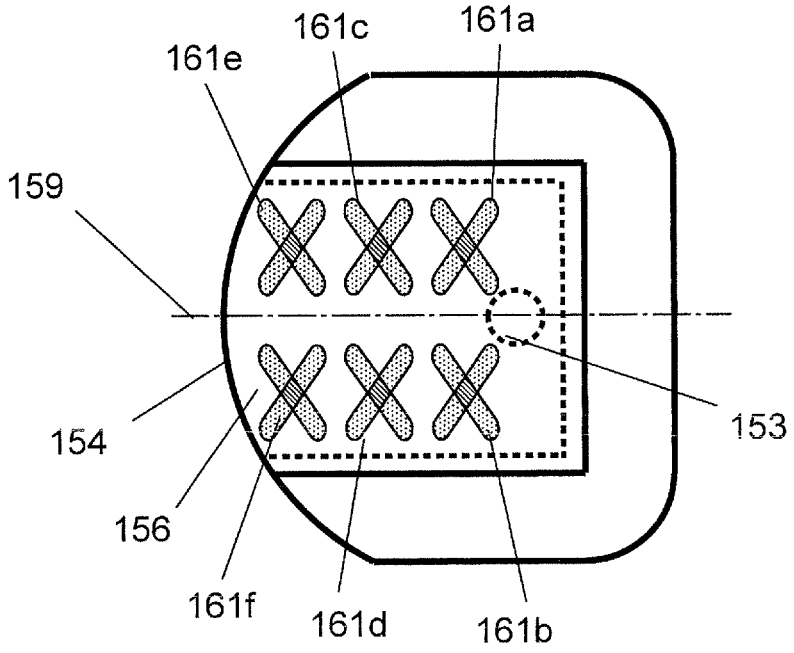
FIG. 24 is a plan view of a waveguide-structure antenna in other embodiment of the present invention.

FIG. 24 depicts an example of non-orthogonal slits of microwave sucking-out openings 161*a*, 161*b*, 161*c*, 161*d*, 161*e*, 161*f*, where the opening shapes are long in the width direction of the upper wall surface 156 and short in the transmission direction. This configuration has an increased number of the openings arranged in the radial direction from the coupling shaft 153 to the distal-end opening part 154. Therefore, the controllability in the radial direction in accordance with the position of the heating object can further be enhanced in terms of the local heating performance of the waveguide-structure antenna so that the local heating can be performed depending on the position of the heating object.

Figure 25:
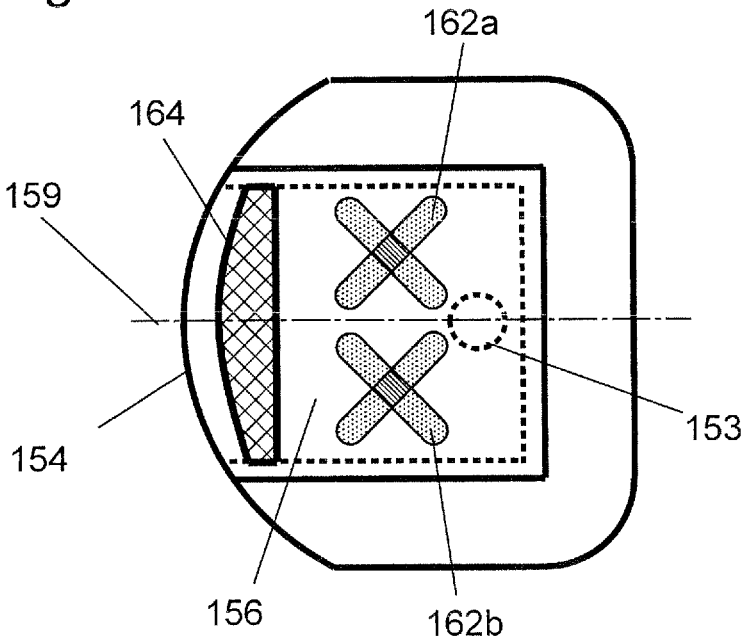
FIG. 25 is a plan view of a waveguide-structure antenna in other embodiment of the present invention.

FIG. 25 depicts an example of having another opening 164. The other opening 164 is a large microwave-radiating opening across the entire width of the upper wall surface 156 and can effectively radiate the remaining microwaves that cannot be sucked out by microwave sucking-out openings 162*a*, 162*b*. Selecting a size of this microwave radiating opening 164 can adjust distribution of microwaves between the radiation from the microwave radiating opening 164 and from the distal-end opening part 154. In particular, the microwave radiating opening 164 is formed at a position more distant from the coupling shaft 153 than the microwave sucking-out openings 162*a*, 162*b* in the wall surface forming the waveguide-structure of the waveguide-structure antenna. Thus, "sucking out" the microwaves from the microwave sucking-out openings 162*a*, 162*b* while "radiating" the microwaves from the microwave radiating opening 164 leads to more flexible microwave radiation.

Figure 26:
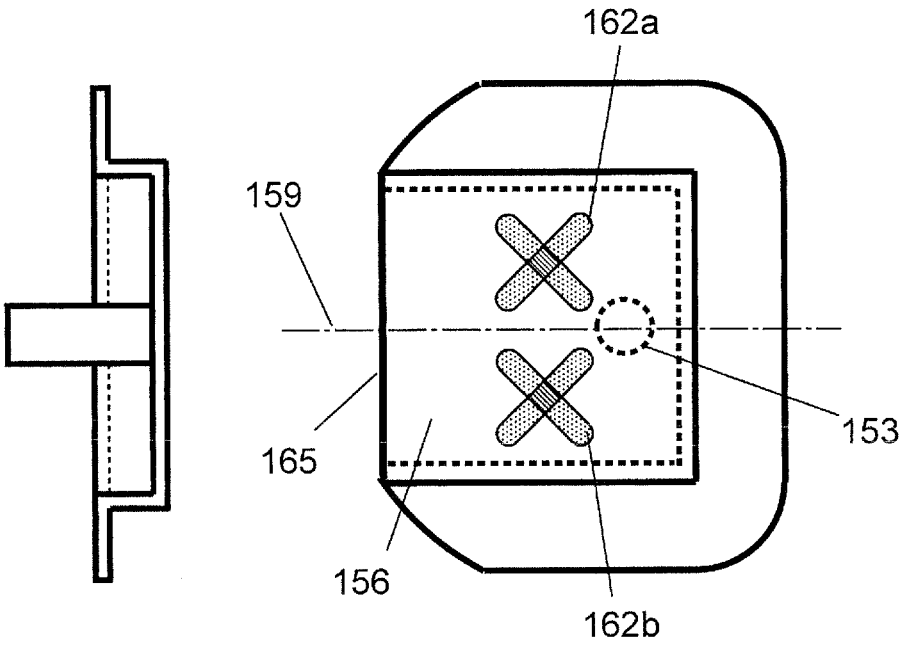
FIG. 26 is a configuration diagram of a waveguide-structure antenna in other embodiment of the present invention.

FIG. 26 depicts a distal-end opening part 165 formed linearly when viewed from above. The above description refers to the distal-end opening part in a circular arc when viewed from above, but not limited thereto, the shape of this embodiment shown in FIG. 26 is also available. In consideration of where to radiate the remaining microwaves that cannot be sucked out by the microwave sucking-out openings 162*a*, 162*b*, the shape/position of the distal-end opening part 165 when viewed from above can be selected as needed other than the linear shape, etc.

Figure 27:
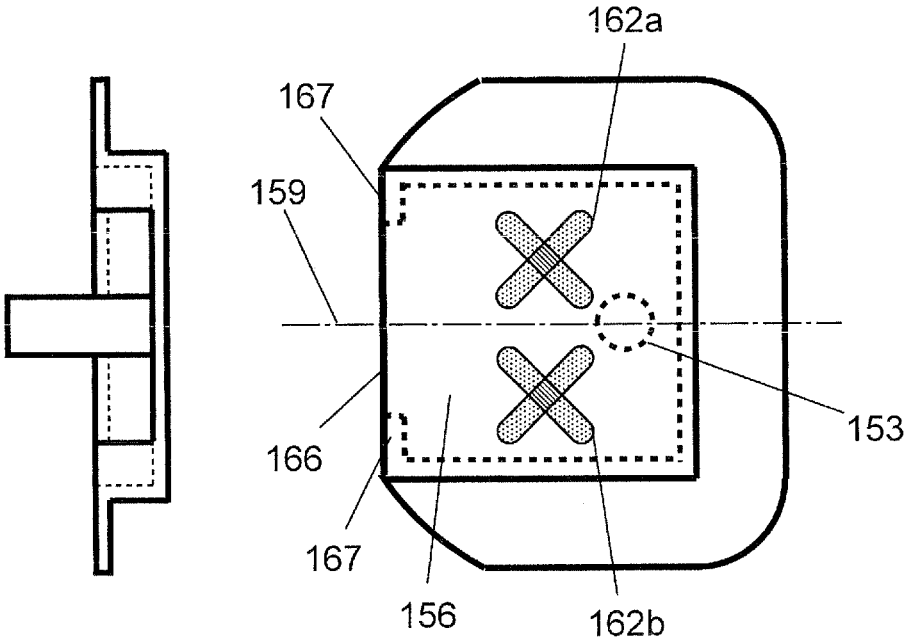
FIG. 27 is a configuration diagram of a waveguide-structure antenna in other embodiment of the present invention.

In FIG. 27, protruding portions 167 which protrudes toward the distal-end opening part 166 are arranged at the both ends of the distal-end opening part 166. Although the above description refers to the distal-end opening part extended to both edges in the width direction, but not limited thereto, the shape of this embodiment shown in FIG. 27 is also available. The distal-end opening part in the above description is wide in the width direction, so microwaves may be radiated not uniformly from the entire distal-end opening part. Thus, microwaves may be radiated strongly from a specific position of the distal-end opening part depending on a material, a shape, or a position of a food, and also the specific position may vary depending on a food. In this regard, disposing the protruding portions 167 as shown in FIG. 27 can realize microwave radiation from the entire distal-end opening part 166. Therefore, the presence/absence of the protruding portions 167 can be selected in consideration of where to radiate the remaining microwaves that cannot be sucked out by the microwave sucking-out openings 162*a*, 162*b*.

Figure 28:
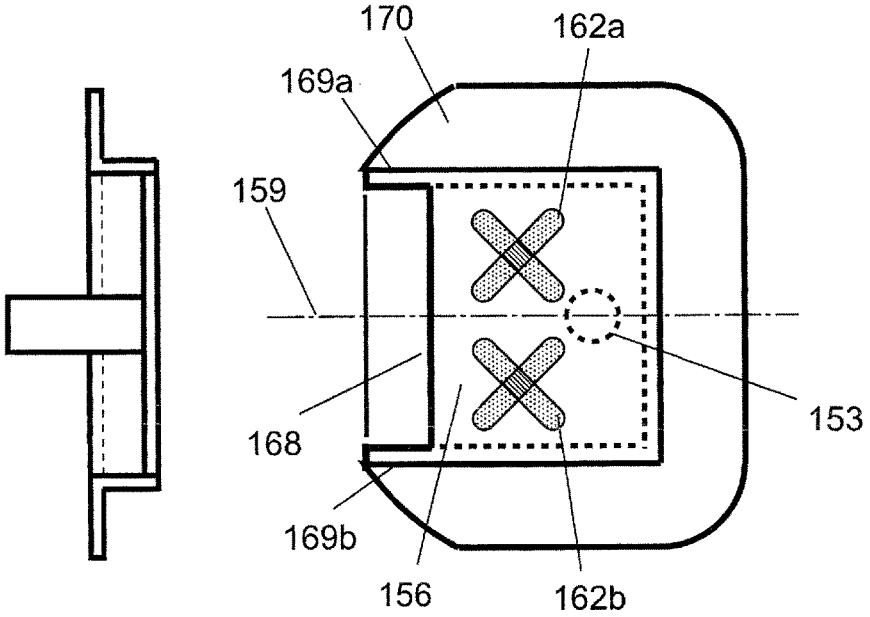
FIG. 28 is a configuration diagram of a waveguide-structure antenna in other embodiment of the present invention.

In FIG. 28, a distal-end opening part 168 is recessed toward the coupling shaft 153 from the distal ends of side walls 169*a*, 169*b* and a flange 170. This configuration allows the side walls 169 and the flange 170 to act as guide, so as to restrain the microwaves radiated from the distal-end opening part 168 from spreading in the width direction of the waveguide (i.e., the vertical direction in FIG. 28).

The distal-end opening part 168 is formed into a linear shape extending near the side walls 169*a*, 169*b*, but such a shape is not limiting. For example, the distal-end opening part may not have a linear shape and also may be curved or stepped. The width and position of the distal-end opening part 168 may be changed as needed.

Figure 29:
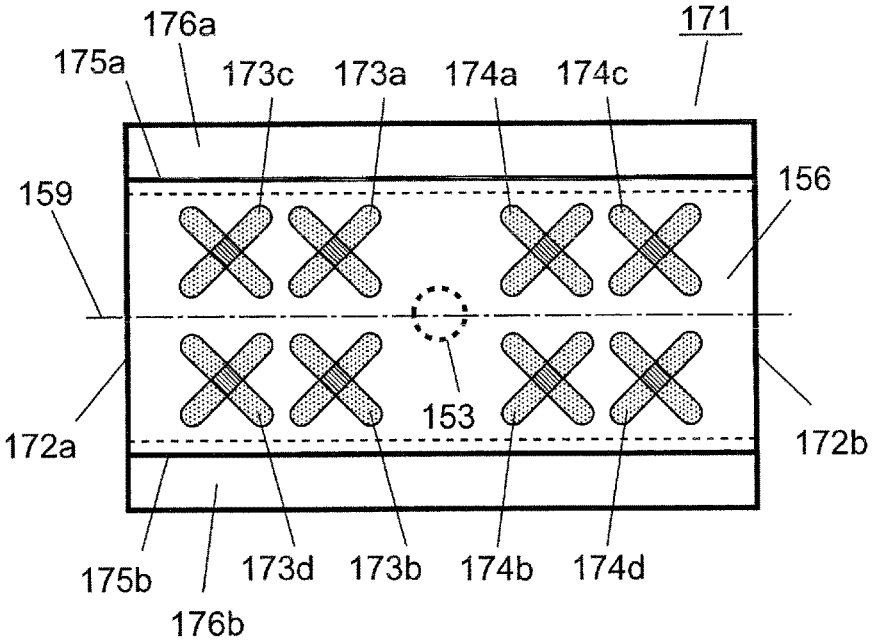
FIG. 29 is a plan view of a waveguide-structure antenna in other embodiment of the present invention.

In FIG. 29, a waveguide-structure 171 is extended on both sides with respect to the coupling shaft 153 to form two distal-end opening parts 172*a*, 172*b*. As the waveguide-structure 171 is extended on the both sides with respect to the coupling shaft 153, microwave sucking-out openings are arranged on the both sides. More specifically, microwave sucking-out openings 173*a*, 173*b*, 173*c*, 173*d* are arranged on the left side with respect to the coupling shaft 153, while the microwave sucking-out openings 174*a*, 174*b*, 174*c*, 174*d* are arranged on the right side with respect to the coupling shaft 153. Side walls and flanges are arranged as side walls 175*a*, 175*b* and flanges 176*a*, 176*b*, respectively (i.e., two walls and two flanges).

Figure 30:
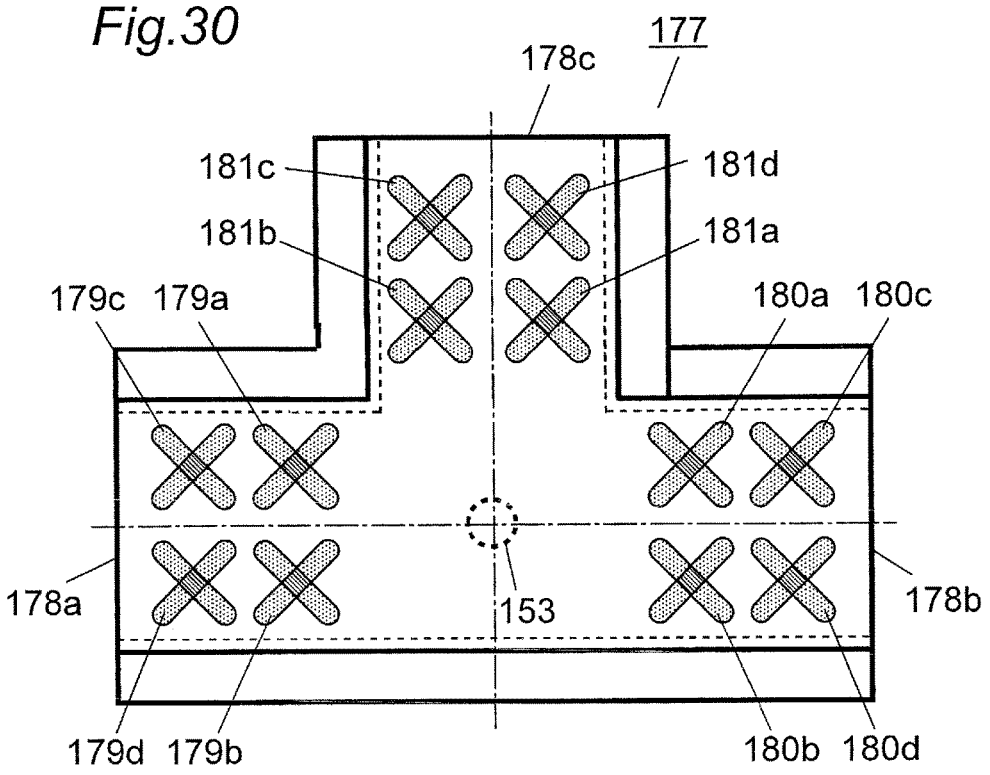
FIG. 30 is a plan view of a waveguide-structure antenna in other embodiment of the present invention.

In FIG. 30, a waveguide-structure 177 is extended from the coupling shaft 153 in three directions like a T-branched (T-shaped) waveguide. As the waveguide-structure 177 is extended in three directions from the coupling shaft 153, distal-end opening parts and microwave sucking-out openings are arranged in three directions. More specifically, a distal-end opening part 178*a* and microwave sucking-out openings 179*a*, 179*b*, 179*c*, 179*d* are arranged on the left side with respect to the coupling shaft 153. A distal-end opening part 178*b* and microwave sucking-out openings 180*a*, 180*b*, 180*c*, 180*d* are arranged on the right side with respect to the coupling shaft 153. A distal-end opening part 178*c* and microwave sucking-out openings 181*a*, 181*b*, 181*c*, 181*d* are arranged on the far side with respect to the coupling shaft 153 (the upper position on the plane of FIG. 30).

The waveguide-structure 177 is T-branched in this embodiment, but not limited thereto, the branches of the waveguide-structure 177 may be arranged at intervals of 120° with each other so as to make rotationally symmetric configuration of the waveguide-structure 177 around the coupling shaft 153. In this case, microwaves can evenly be transmitted in three directions with respect to the coupling shaft 153. The waveguide-structure 177 may be branched in four directions to be formed into crossing shape, or may be branched in more directions. The number of openings can be increased with increasing branches.

Figure 31:
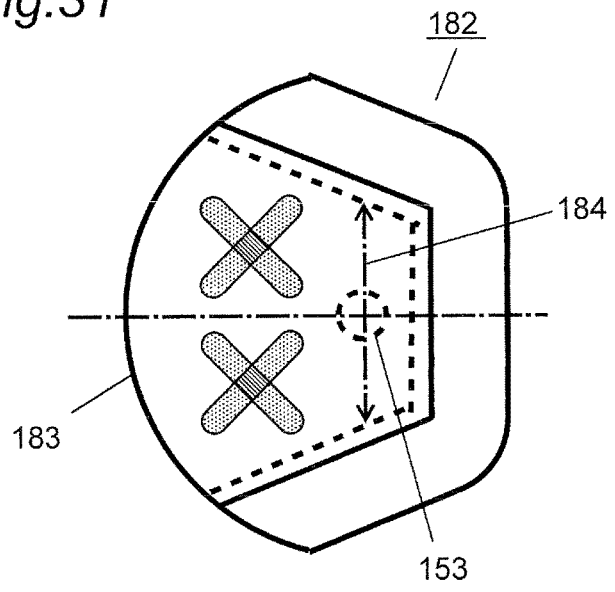
FIG. 31 is a plan view of a waveguide-structure antenna in other embodiment of the present invention.

FIG. 31 depicts a configuration with a waveguide-structure 182 gradually made wider from the coupling shaft 153 toward the distal-end opening part 183. Although the above description states that the width "a" may be selected as $\lambda 0>a>\lambda 0/2$ for a waveguide, the width "a" may be greater than $\lambda 0$ in the vicinity of the distal-end opening part 183 because microwaves can be radiated from the distal-end opening part 183 to a free space. It can be considered that a width 184 of the waveguide in the vicinity of the coupling shaft 153 only needs to be smaller than $\lambda 0$.

Figure 32:
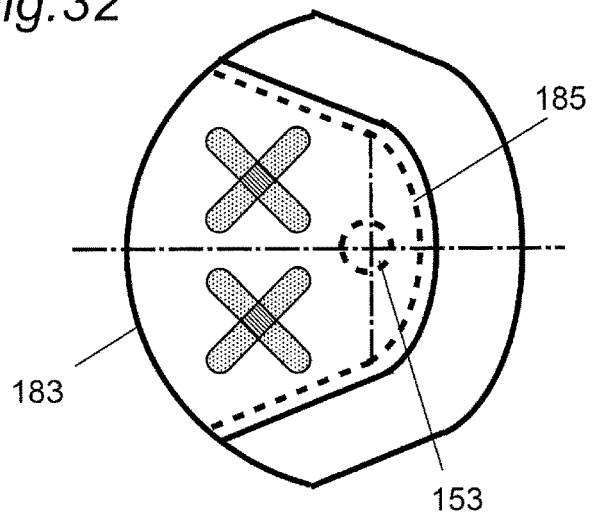
FIG. 32 is a plan view of a waveguide-structure antenna in other embodiment of the present invention.

In FIG. 32, unlike the above examples, a side wall surface 185 on the opposite side of the distal-end opening part 183 relative to the coupling shaft 153 is not linear-shaped and is curved when viewed from above.

Figure 33A:
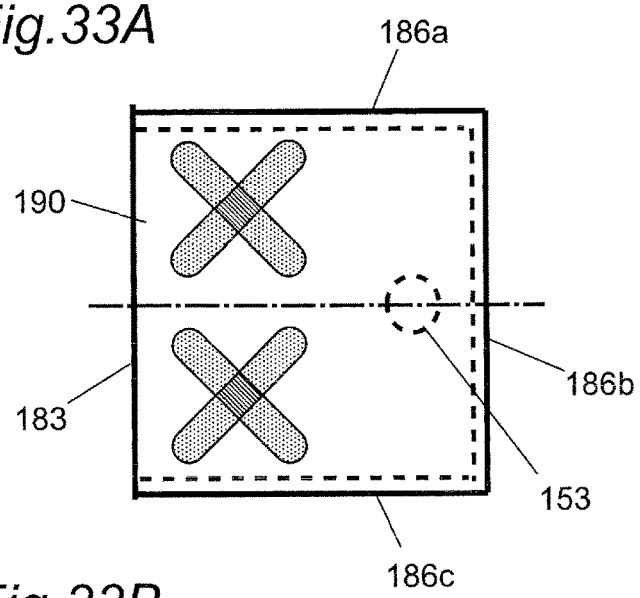
FIG. 33A is a plan view of a waveguide-structure antenna in other embodiment of the present invention.
Figure 33B:
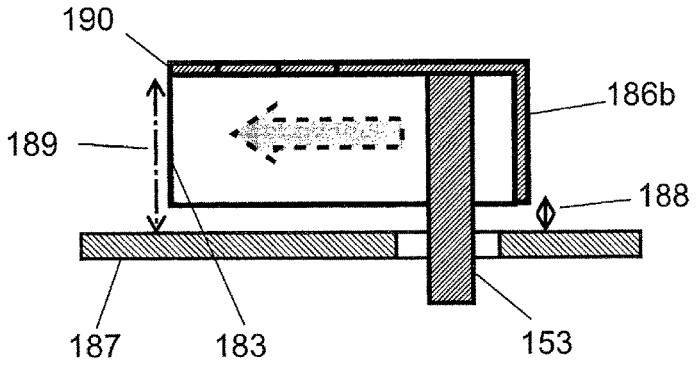
FIG. 33B is a cross-sectional front view of the waveguide-structure antenna in the other embodiment of the present invention.
Figure 34:
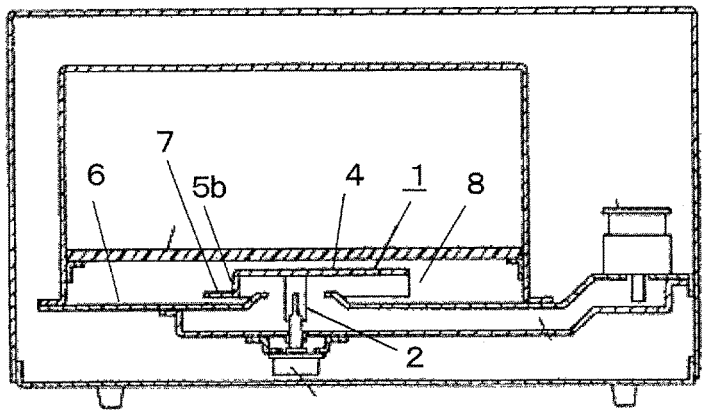
FIG. 34 is a cross-sectional front view of a conventional microwave heating apparatus of Patent Document 1.
Figure 35:
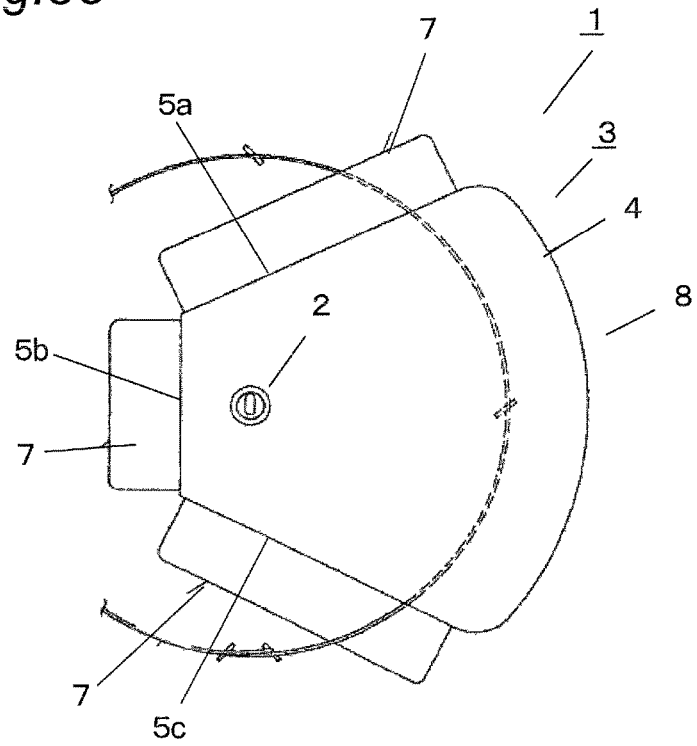
FIG. 35 is a plan view of a conventional waveguide-structure antenna of Patent Document 1.
Figure 36:
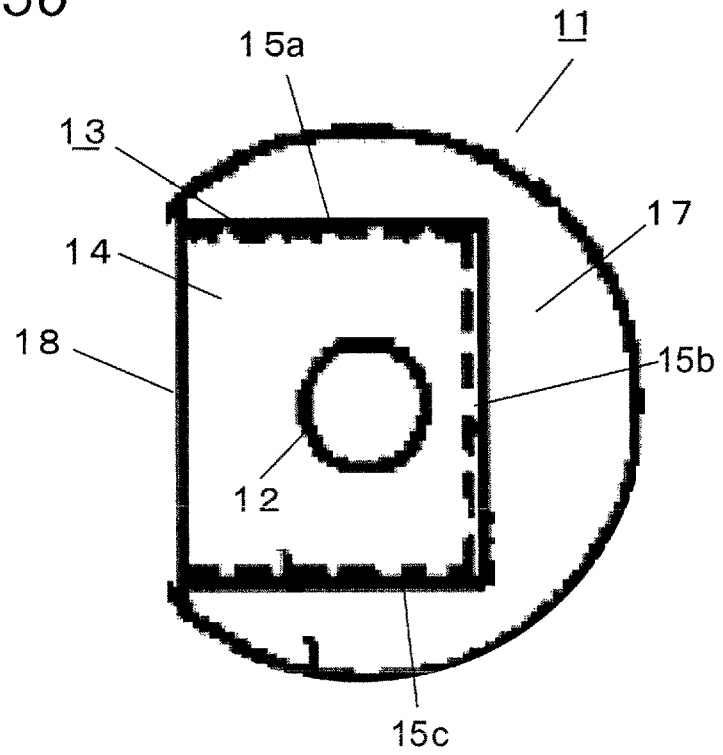
FIG. 36 is a plan view of a conventional waveguide-structure antenna of Patent Document 2.
Figure 37:
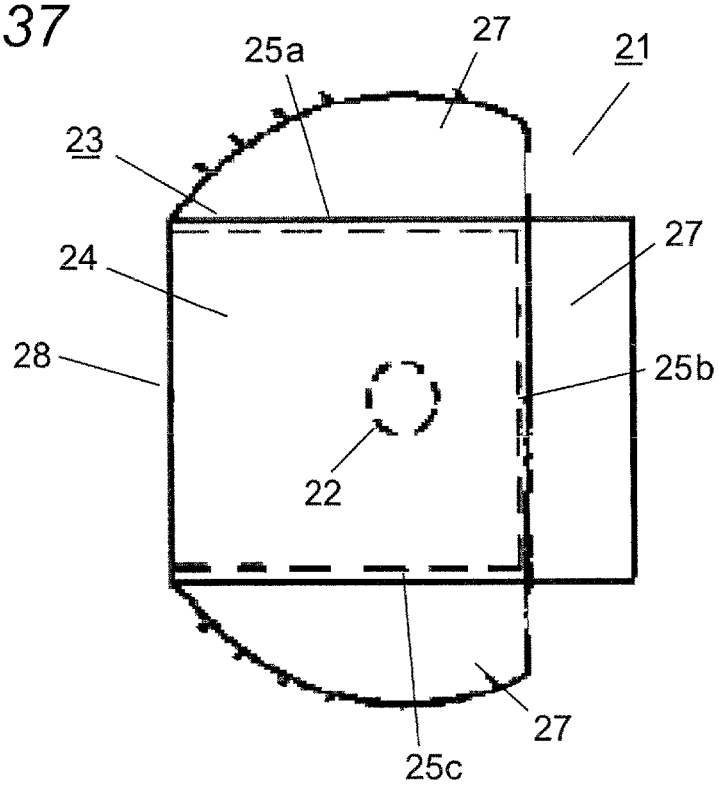
FIG. 37 is a plan view of the waveguide-structure antenna of Patent Document 2.

In FIGS. 33A and 33B, unlike the above examples, no flange is provided on the outside of side wall surfaces 186*a*, 186*b*, 186*c*. FIG. 33A is a view of a waveguide viewed from above while FIG. 33B is a cross-sectional view from the front side. As is apparent from FIG. 33B, even when no flange is provided, a gap 188 between the side wall surfaces 186*a*, 186*b*, 186*c* and a heating chamber bottom surface 187 is far narrower than a gap 189 between an upper wall surface 190 and the heating chamber bottom surface 187. When the former gap is narrower, impedance is made lower and microwaves are less transmitted from the gap. Therefore, even if the configuration shown in FIGS. 33A and 33B has no flange, a large portion of the microwaves can be transmitted toward the distal-end opening part 183. Thus, this embodiment shown in FIGS. 33A and 33B can make the outer shape of the waveguide smaller by eliminating the flange, thereby enabling adjustment of expanding the waveguide-structure itself with enlarging openings or of increasing the number of openings. On the other hand, when the outer shape of the waveguide becomes smaller, a torque for rotational drive of the waveguide can be reduced, thereby leading to cost reduction of the antenna itself or the rotation driving unit. However, if no flange is provided, the distal ends of the side wall surfaces 186*a*, 186*b*, 186*c* face the heating chamber bottom surface 187 and, therefore, an intense electric field is generated, easily causing a spark. Therefore, to avoid the spark risks, a thin insulating resin spacer (having a thickness equal to or less than the gap 188) may be interposed between the side wall surfaces 186*a*, 186*b*, 186*c* and the heating chamber bottom surface 187.

The above description mainly refers to the microwave sucking-out opening having a substantially X-shape of two long crossing holes for sucking out the circularly polarized microwaves, but such a case is not limiting. The shape of the microwave sucking-out opening may be a shape other than the substantially X-shape. The shape may be formed such that microwaves other than the circularly polarized waves are sucked out. The long holes (or slits) are not limited to rectangular holes. The circularly polarized waves can be generated even when a corner portion of an opening is curved or formed into an elliptic shape. It can be inferred that a basic concept of the circular polarization opening may be to combine two holes of basically elongated shapes longer in one direction and shorter in a direction orthogonal thereto.

The above description refers to the microwave sucking-out opening formed in the upper wall surface (in other words, the wall surface distant from a heating chamber wall surface, the wall surface close to the heating object, or the wall surface facing the heating chamber wall surface) among the wall surfaces forming the waveguide-structure, such a case is not limiting. For example, the microwave sucking-out opening may be formed in a wall surface other than the upper wall surface among the wall surfaces forming the waveguide-structure.

As described above, the microwave heating apparatus of the present invention can improve the local heating performance of the waveguide-structure antenna for radiating microwaves to a heating object and is therefore effectively utilized as a microwave heating apparatus for performing heat processing or sterilization of food.

Although the present invention has been fully described by way of preferred embodiments with reference to the accompanying drawings, it is to be noted here that various changes and modifications will be apparent to those skilled in the art. Therefore, unless such changes and modifications otherwise depart from the scope of the present invention as set forth in the appended claims, they should be construed as being included therein.

The contents of specifications, drawings and claims of the Japanese patent application No. 2013-088091 filed Apr. 19, 2013 and the Japanese patent application No. 2013-129154 filed Jun. 20, 2013 are herein expressly incorporated by reference in their entirety.

What is claimed is:

1. A microwave heating apparatus comprising:

a heating chamber which houses a heating object;

a microwave generating unit which generates a microwave;

a transmitting unit which transmits the microwave generated by the microwave generating unit;

a waveguide-structure antenna which radiates to the heating chamber the microwave transmitted from the transmitting unit;

a coupling shaft which couples the microwave transmitted from the transmitting unit to the waveguide-structure antenna; and a rotation driving unit which drives the waveguide-structure antenna to rotate, wherein the waveguide-structure antenna has a microwave sucking-out opening as a circular polarization opening that has a shape to radiate a circularly polarized microwave and is formed in an upper wall surface forming a waveguide structure of the waveguide-structure antenna, wherein:

the waveguide-structure antenna has at its distal end a distal-end opening part opened to radiate the microwave coupled by the coupling shaft, wherein the waveguide-structure antenna has side wall surfaces to close the waveguide-structure around the upper wall surface other than the distal-end opening part, wherein a maximum length of the microwave sucking-out opening is ¼ or more and ½ or less of a wavelength of the microwave generated by the microwave generating unit, wherein the microwave sucking-out opening is offset from the center in a width direction of the wall surface, and wherein both the microwave sucking-out opening and the distal-end part change their microwave radiating amount according to a change in dielectric constant in the vicinity.

2. The microwave heating apparatus of claim 1, wherein the microwave sucking-out opening has a shape of two crossing slits.

3. The microwave heating apparatus of claim 1, wherein a plurality of the microwave sucking-out openings are arranged in an extending direction of the waveguide-structure antenna.

4. The microwave heating apparatus of claim 1, further comprising a state-detecting unit which detects a state of the heating object in the heating chamber, wherein the rotation driving unit controls a rotational position of the waveguide-structure antenna based on the state of the heating object detected by the state-detecting unit.

5. The microwave heating apparatus of claim 1, wherein the rotation driving unit controls a rotational position of the waveguide-structure antenna based on a predetermined program selectable by a user.

6. The microwave heating apparatus of claim 1, wherein the microwave sucking-out opening is arranged only on one side relative to the center in the width direction of the wall surface.

7. The microwave heating apparatus of claim 1, wherein the microwave sucking-out openings are arranged on the both sides relative to the center in the width direction of the wall surface.

8. The microwave heating apparatus of claim 1, wherein the microwave sucking-out opening is arranged at a position closer to the coupling shaft than the distal-end opening part in an extending direction of the waveguide-structure antenna.

9. The microwave heating apparatus of claim 1, wherein a microwave radiating opening is formed at a position more distance from the coupling shaft than the microwave sucking-out opening in the wall surface forming the waveguide structure.

10. The microwave heating apparatus of claim 1, wherein the distal-end opening parts and the microwave-radiating openings in the waveguide-structure antenna are both arranged on one side and the other side relative to the coupling shaft.

* * * * *